US007249829B2

(12) United States Patent
Hawkins et al.

(10) Patent No.: US 7,249,829 B2
(45) Date of Patent: Jul. 31, 2007

(54) HIGH SPEED, HIGH QUALITY LIQUID PATTERN DEPOSITION APPARATUS

(75) Inventors: Gilbert A. Hawkins, Mendon, NY (US); Stephen F. Pond, Williamsburg, VA (US)

(73) Assignee: Eastman Kodak Company, Rochester, NY (US)

( * ) Notice: Subject to any disclaimer, the term of this patent is extended or adjusted under 35 U.S.C. 154(b) by 256 days.

(21) Appl. No.: 11/130,621

(22) Filed: May 17, 2005

(65) Prior Publication Data

US 2006/0262168 A1 Nov. 23, 2006

(51) Int. Cl.
*B41J 2/07* (2006.01)

(52) U.S. Cl. ..... 347/74

(58) Field of Classification Search ..... 347/74, 347/75, 76, 77, 78, 80
See application file for complete search history.

(56) References Cited

U.S. PATENT DOCUMENTS

| | | | | |
|---|---|---|---|---|
| 3,878,519 | A | 4/1975 | Eaton | |
| 4,638,328 | A | 1/1987 | Drake | |
| 6,450,628 | B1 * | 9/2002 | Jeanmaire et al. | 347/75 |
| 6,485,134 | B2 * | 11/2002 | Dunand | 347/74 |
| 6,491,362 | B1 | 12/2002 | Jeanmaire | |

(Continued)

FOREIGN PATENT DOCUMENTS

EP 1 219 429 7/2002

(Continued)

OTHER PUBLICATIONS

F.R.S. (Lord) Rayleigh, "Instability of Jets," Proc. London Math. Soc. 10 (4), published in 1878.

(Continued)

*Primary Examiner*—K. Feggins
(74) *Attorney, Agent, or Firm*—Stephen Pond Consultants

(57) ABSTRACT

A drop deposition apparatus for laying down a patterned liquid layer on a receiver substrate, for example, a continuous ink jet printer, is disclosed. The liquid deposition apparatus comprises a drop emitter containing a positively pressurized liquid in flow communication with a linear array of nozzles for emitting a plurality of continuous streams of liquid having nominal stream velocity $v_{j0}$, wherein the plurality of nozzles have effective nozzle diameters $D_0$ and extend in an array direction with an effective nozzle spacing $L_y$. Resistive heater apparatus is adapted to transfer thermal energy pulses of period $\tau_0$ to the liquid in flow communication with the plurality of nozzles sufficient to cause the break-off of the plurality of continuous streams of liquid into a plurality of streams of drops of predetermined nominal drop volume $V_0$. Relative motion apparatus is adapted to move the drop emitter and receiver substrate relative to each other in a process direction at a process velocity S so that individual drops are addressable to the receiver substrate with a process direction addressability, $A_p=\tau_0 S$. The effective nozzle spacing is less than 85 microns, the process speed S is at least 1 meter/sec and the addressability, $A_p$, of individual drops at the receiver substrate in the process direction is less than 6 microns. Drop deposition apparatus is disclosed wherein the predetermined volumes of drops include drops of a unit volume, $V_0$, and drops having volumes that are integer multiples of the unit volume, $mV_0$. Further apparatus is adapted to inductively charge at least one drop and to cause electric field deflection of charged drops.

26 Claims, 27 Drawing Sheets

U.S. PATENT DOCUMENTS 6,511,164 B1 * 1/2003 Bajeux ..... 347/74
6,851,796 B2 * 2/2005 Jeanmaire et al. ..... 347/74

FOREIGN PATENT DOCUMENTS

EP 1 232 864 8/2002
EP 1 234 669 8/2002

OTHER PUBLICATIONS

Furlani, In J. Phys. A: Mathematical and General, 38, (2005) 263-276.
Carslaw and Jaeger, Conduction of Heat in Solids, Chapter 13, Oxford University Press, pp. 327-352.
Tseng, Lee and Zhao "Design and Operation Of A Droplet Deposition Systems For Freeform Fabrication Of Metal Parts" Journal of Engineering Mat. and Tech., 74/vol. 123, Jan. 2001.

* cited by examiner

BOL n
BOL o
100
110
500
77
76
66
64
62
70
80
12
14
20
24
16
10
48
60
28
30
18
22
D0
v j0
λ0

HIGH SPEED, HIGH QUALITY LIQUID PATTERN DEPOSITION APPARATUS

FIELD OF THE INVENTION

This invention relates generally to continuous stream type drop emitters, especially ink jet printing systems, and more particularly to printheads which stimulate the ink in the continuous stream type ink jet printers by thermal energy pulses and are capable of very high resolution liquid pattern deposition.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Other applications, requiring very precise, non-contact liquid pattern deposition, may be served by drop emitters having similar characteristics to very high resolution ink jet printheads. By very high resolution liquid layer patterns, it is meant, herein, patterns formed of pattern cells (pixels) having spatial densities of at least 300 per inch in two dimensions. It is further meant that the liquid may be incrementally metered within a pattern cell in multiple subunits to produce a "grey scale" effect, using smallest unit drop volumes of less than 10 pL.

Ink jet printing mechanisms can be categorized by technology as either drop on demand ink jet or continuous ink jet. The first technology, "drop-on-demand" ink jet printing, provides ink droplets that impact upon a recording surface by using a pressurization actuator (thermal, piezoelectric, etc.). Many commonly practiced drop-on-demand technologies use thermal actuation to eject ink droplets from a nozzle. A heater, located at or near the nozzle, heats the ink sufficiently to boil, forming a vapor bubble that creates enough internal pressure to eject an ink droplet. Other well known drop-on-demand droplet ejection mechanisms include piezoelectric actuators.

Drop-on-demand drop emitter systems are limited in the drop repetition frequency that is sustainable from an individual nozzle. In order to produce consistent drop volumes and to counteract front face flooding, the ink supply is typically held at a slightly negative pressure. The time required to re-fill the drop generation chambers and passages, including some settling time, limits the drop repetition frequency. Drop repetition frequencies ranging up to ~50 KHz may be possible for drops having volumes of 10 picoLiters (pL) or less. However, a drop frequency maximum of 50 KHz limits the usefulness of drop-on-demand emitters for high quality patterned layer deposition to process speeds below ~0.5 m/sec.

The second ink jet technology, commonly referred to as "continuous" ink jet (CIJ) printing, uses a pressurized ink source that produces a continuous stream of ink droplets from a nozzle. The stream is perturbed in some fashion causing it to break up into uniformly sized drops at a nominally constant distance, the break-off length, from the nozzle. Since the source of pressure is remote from the nozzle (typically a pump is used to feed pressurized ink to the printhead), the space occupied by the nozzles is very small. CIJ drop generators do not have a "refill" limitation since the drop formation process occurs after ejection from the nozzle, and thus can operate at frequencies approaching a megahertz. In light of these characteristics, it is surprising that CIJ drop generators have not been employed in high density arrays for very high speed, very high quality deposition of materials. However, despite the need for apparatus to effect such deposition, for example apparatus to deposit high resolution patterns of electronic materials, no high density arrays have been reported or commercialized.

CIJ drop generators rely on the physics of an unconstrained fluid jet, first analyzed in two dimensions by F. R. S. (Lord) Rayleigh, "Instability of jets," Proc. London Math. Soc. 10 (4), published in 1878. Lord Rayleigh's analysis showed that liquid under pressure, P, will stream out of a hole, the nozzle, forming a jet of diameter, $D_j$, moving at a velocity, $v_j$. The jet diameter, $D_j$, is approximately equal to the effective nozzle diameter, $D_n$, and the jet velocity is proportional to the square root of the reservoir pressure, P. Rayleigh's analysis showed that the jet will naturally break up into drops of varying sizes based on surface waves that have wavelengths, $\lambda$, longer than $\pi D_j$, i.e. $\lambda \geqq \pi D_j$. Rayleigh's analysis also showed that particular surface wavelengths would become dominate if initiated at a large enough magnitude, thereby "synchronizing" the jet to produce mono-sized drops. Individual CIJ drop generators or low density arrays of CIJ drop generators may be configured to produce the 100's of 1000's of small (>10 pL) drops per second, which is one of the requirements needed for high quality patterned layered deposition process speeds above 0.5 m/sec.

However, large arrays of CIJ jets having jets spaced more closely than 300 jets per inch, meeting the requirements desired for high quality patterned deposition of materials, have been difficult to fabricate using conventional nozzle fabrication methods such as nickel electroforming and drop generator assembly of multiple layers and piece parts. In addition, commercially practiced CIJ printheads use a piezoelectric device, acoustically coupled to the printhead, to initiate a dominant surface wave on the jet leading to "Rayleigh" break-up into streams of mono-sized drops. It is quite difficult to produce uniform acoustic stimulation for long arrays of closely spaced jets. Further, conventional CIJ nozzle fabrication methods have not been successful producing long arrays of nozzles having diameters less than 15 microns, as is needed to form drops of less than 10 pL.

Because of the difficulties of traditional CIJ fabrication techniques and acoustic stimulation, even though the continuous drop emission process is capable of high drop repetition frequencies, practical systems comprising large arrays of CIJ nozzles that can produce a very high resolution patterned layer at process speeds above 0.5 m/sec have not been commercially realized, despite the need for such arrays for use in the printing of images and for patterning materials, such as thin-film electronic materials, a market widely acknowledged to be growing and potentially lucrative. An alternate jet perturbation concept that overcomes the drawbacks of acoustic stimulation was disclosed for a single jet CIJ system in U.S. Pat. No. 3,878,519 issued Apr. 15, 1975 to J. Eaton (Eaton hereinafter). Eaton discloses the thermal stimulation of a jet fluid filament by means of localized light energy or by means of a resistive heater located at the nozzle, the point of formation of the fluid jet. Eaton explains that the fluid properties, especially the surface tension, of a heated portion of a jet may be sufficiently changed with respect to an unheated portion to cause a localized change in the diameter of the jet, thereby launching a dominant surface wave if applied at an appropriate frequency.

Eaton teaches his invention using calculational examples and parameters relevant to a state-of-the-art ink jet printing application circa the early 1970's, i.e. a drop frequency of 100 KHz and a nozzle diameter of ~25 microns leading to drop volumes of ~60 pL. Eaton does not teach or disclose how to configure or operate a thermally-stimulated CIJ printhead that would be needed to print drops an order of magnitude smaller and at substantially higher drop frequencies.

U.S. Pat. No. 4,638,328 issued Jan. 20, 1987 to Drake, et al. (Drake hereinafter) discloses a thermally-stimulated multi-jet CIJ drop generator fabricated in an analogous fashion to a thermal ink jet device. That is, Drake discloses the operation of a traditional thermal ink jet (TIJ) edge-shooter or roofshooter device in CIJ mode by supplying high pressure ink and applying energy pulses to the heaters sufficient to cause synchronized break-off but not so as to generate vapor bubbles. The inventions claimed and taught by Drake are specific to CIJ devices fabricated using two substrates that are bonded together, one substrate being planar and having heater electrodes and the other having topographical features that form individual ink channels and a common ink supply manifold. Drake does not disclose a high resolution, very high speed CIJ configuration Thermally stimulated CIJ devices may be fabricated using emerging microelectromechanical (MEMS) fabrication methods and materials. By applying microelectronic fabrication process accuracies to the construction of a thermally stimulated CIJ drop emitter, the inventors of the present inventions have realized that a liquid pattern deposition apparatus may be provided having heretofore unknown resolution and process speed capability. The physical parameters relating to continuous stream drop formation are constrained within certain boundaries to ensure the capability of providing a desired combination of pattern resolution, grey scale, drop volume uniformity, minimization of mist and spatter, and process speed. Such an apparatus has application for very high speed, photographic quality printing as well as for manufacturing applications requiring the non-contact deposition of high precision patterned liquid layers. The ability of MEMS fabrication methods to provide very high speed, high quality deposition of materials has heretofore been unrecognized, because an analysis of the many device and device fabrication parameters and of the design rules for the manufacture of such devices has not been undertaken. Although experimental devices have been built and disclosed that satisfy some of the requirements of high speed, high quality materials deposition, unguided experimental exploration of the many design and operational parameters of thermally stimulated CIJ printheads has failed to provide functional arrays of CIJ nozzles capable of high speed, high quality materials deposition. Such an analysis must include recognition of the implications of MEMS fabrication technologies as applied to thermally the stimulated inkjet devices.

SUMMARY OF THE INVENTION

The foregoing and numerous other features, objects and advantages of the present invention will become readily apparent upon a review of the detailed description, claims and drawings set forth herein. These features, objects and advantages are accomplished by a drop deposition apparatus constructed for laying down a patterned liquid layer on a receiver substrate, for example, a continuous ink jet printer. The liquid deposition apparatus comprises a drop emitter containing a positively pressurized liquid in flow communication with a linear array of nozzles for emitting a plurality of continuous streams of liquid having nominal stream velocity $v_{j0}$, wherein the plurality of nozzles have effective nozzle diameters $D_0$ and extend in an array direction with an effective nozzle spacing $L_y$. Resistive heater apparatus is adapted to transfer thermal energy pulses of period $\tau_0$ to the liquid in flow communication with the plurality of nozzles sufficient to cause the break-off of the plurality of continuous streams of liquid into a plurality of streams of drops of predetermined nominal drop volume $V_0$. Relative motion apparatus is adapted to move the drop emitter and receiver substrate relative to each other in a process direction at a process velocity S so that individual drops are addressable to the receiver substrate with a process direction addressability, $A_p=\tau_0 S$. The effective nozzle spacing is less than 85 microns, the process speed S is at least 1 meter/sec and the addressability, $A_p$, of individual drops at the receiver substrate in the process direction is less than 6 microns. Drop deposition apparatus is disclosed wherein the predetermined volumes of drops include drops of a unit volume, $V_0$, and drops having volumes that are integer multiples of the unit volume, $mV_0$. Further apparatus is adapted to inductively charge at least one drop and to cause electric field deflection of charged drops.

It is therefore an object of the present inventions to provide a drop deposition apparatus for laying down a very high resolution patterned liquid layer on a receiver substrate while controlling mist and spatter.

It is also an object of the present inventions to provide a liquid pattern deposition apparatus utilizing thermally stimulated continuous drop emitter that operates at high drop repetition frequencies enabling high layer deposition process speeds.

It is further an object of the present inventions to provide for numerous grey scale levels in a patterned liquid pattern while maintaining drop volume uniformity among jets.

It is further an object of the present inventions to provide a liquid pattern deposition system utilizing drop charging and deflection to form the liquid pattern.

It is also an object of the present invention to provide an ink jet printing apparatus capable of very high image quality at very high print media speeds.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The invention has been described in detail with particular reference to certain preferred embodiments thereof, but it will be understood that variations and modifications can be effected within the spirit and scope of the invention. The present description will be directed in particular to elements forming part of, or cooperating more directly with, apparatus in accordance with the present invention. Functional elements and features have been given the same numerical labels in the figures if they are the same element or perform the same function for purposes of understanding the present inventions. It is to be understood that elements not specifically shown or described may take various forms well known to those skilled in the art.

Figures 1A, 1B:
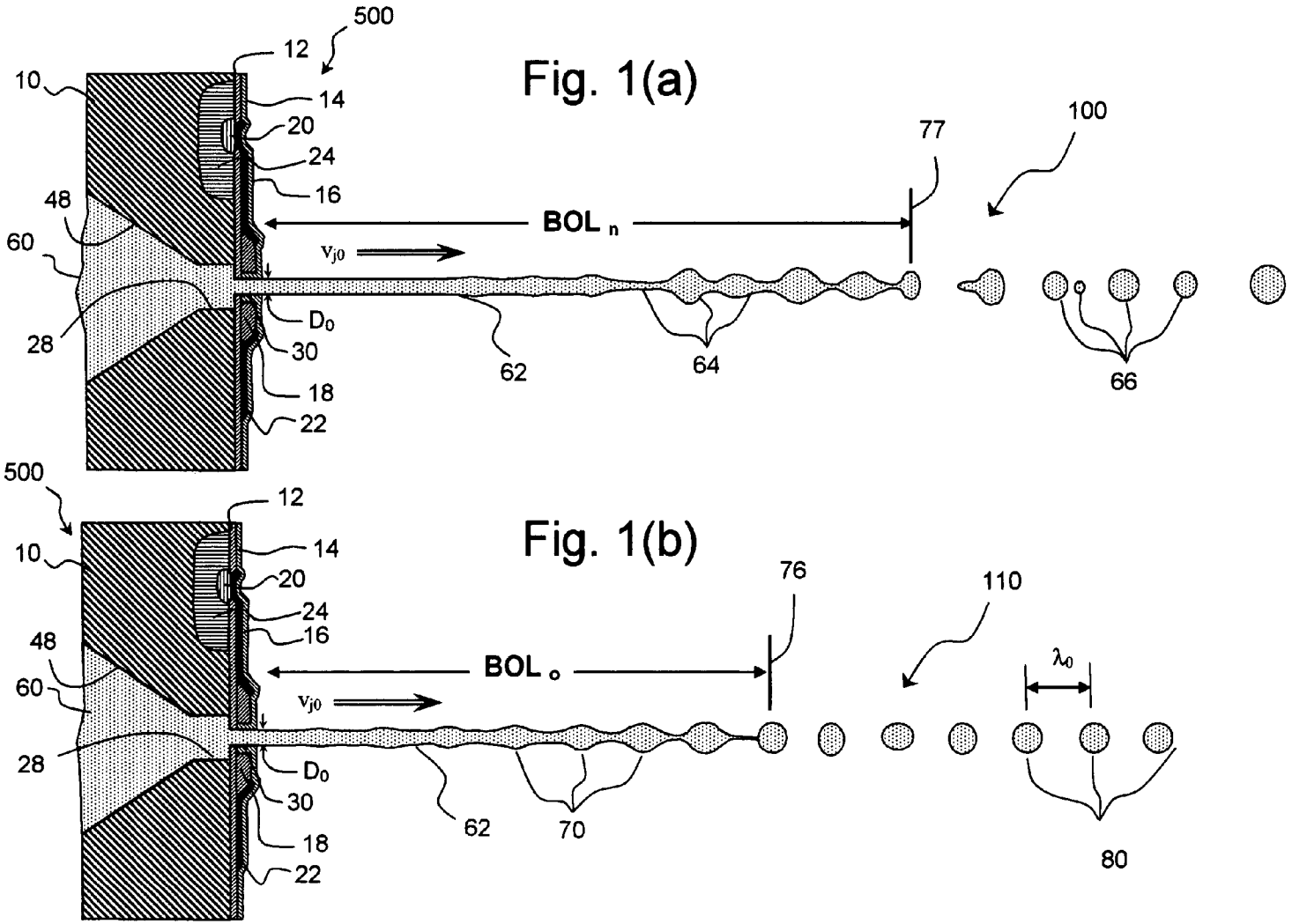
FIGS. 1(*a*) and 1(*b*) are side view illustrations of a continuous liquid stream undergoing natural break-up into drops and thermally stimulated break up into drops of predetermined volumes respectively.

Referring to FIGS. 1(*a*) and 1(*b*), there is shown a portion 500 of a liquid emission apparatus wherein a continuous stream of liquid 62, a liquid jet, is emitted from a nozzle 30 supplied by a liquid 60 held under high pressure in a liquid emitter chamber 48. Portion 500 of the liquid emission apparatus is herein termed a drop generator or drop emitter. The liquid is emitted from nozzle 30 with a jet velocity, $v_{j0}$, which is approximately proportional to the square root of the reservoir pressure. The liquid stream 62 in FIG. 1(*a*) is illustrated as breaking up into droplets 66 after some distance 77 of travel from the nozzle 30. The liquid stream illustrated will be termed a natural liquid jet or stream of drops of undetermined volumes 100. The travel distance 77 is commonly referred to as the break-off length (BOL). The liquid stream 62 in FIG. 1(*a*) is breaking up naturally into drops of varying volumes. As noted above, the physics of natural liquid jet break-up was analyzed in the late nineteenth century by Lord Rayleigh and other scientists. Lord Rayleigh explained that surface waves form on the liquid jet having spatial wavelengths, λ, that are related to the diameter of the jet, $D_j$, that is nearly equal to the nozzle 30 diameter, $D_0$. These naturally occurring surface waves, $\lambda_n$, have lengths that are distributed over a range of approximately, $\pi D_j \leqq \lambda_n \leqq 10 D_j$.

FIG. 1(*b*) illustrates a liquid stream 62 that is being controlled to break up into drops of predetermined volumes 80 at predetermined intervals, $\lambda_0$. The break-up control or synchronization of liquid stream 62 is achieved by a resistive heater apparatus adapted to apply thermal energy pulses to the flow of pressurized liquid 60 immediately prior to the nozzle 30. One embodiment of a suitable resistive heater apparatus according to the present inventions is illustrated by heater resistor 18 that surrounds the fluid 60 flow. Resistive heater apparatus according to the present inventions will be discussed in more detail herein below. The synchronized liquid stream 62 is caused to break up into a stream of drops of predetermined volume, $V_0 \approx \lambda_0(\pi D_0^2/4)$ by the application of thermal pulses that cause the launching of a dominant surface wave 70 on the jet. To launch a synchronizing surface wave of wavelength $\lambda_0$ the thermal pulses are introduced at a frequency $f_0 = v_{j0}/\lambda_0$, where $v_{j0}$ is the desired operating value of the liquid stream velocity. The period of the thermal stimulation pulses is to $t_0 = 1/f_0$.

For the purpose of understanding the present inventions the jet diameter will be approximated by the nozzle 30 diameter, $D_0$, i.e. $D_j = D_0$. The jet diameter will be only a few percent smaller than the nozzle diameter for liquids having relatively low viscosities, i.e. v<20 cpoise. Further it is customary to relate the wavelength, $\lambda_n$, of surface waves to the jet diameter, $D_0$, using a dimensionless "wave ratio", L. In the explanation of the present inventions herein, the dimensionless wave ratio, L, will be frequently used in place of the wavelength, $\lambda_n = L\,D_0$.

Natural surface waves 64 having different wavelengths grow in magnitude until the continuous stream is broken up into droplets 66 having varying volumes that are indeterminate within a range that corresponds to the above remarked wavelength range. That is, the naturally occurring drops 66 have volumes $V_n \approx \lambda_n(\pi D_0^2/4)$, or a volume range: $(\pi^2 D_0^3/4) \leqq V_n \leqq (10\pi D_0^3/4)$. In addition there are extraneous small ligaments of fluid that form small drops termed "satellite" drops among main drop leading to yet more dispersion in the drop volumes produced by natural fluid streams or jets. FIG. 1(*a*) illustrates natural stream break-up at one instant in time. In practice the break-up is chaotic as different surfaces waves form and grow at different instants. A break-off length for the natural liquid jet 100, $BOL_n$, is indicated; however, this length is also highly time-dependent and indeterminate within a wide range of lengths.

A one-dimensional analysis of jet break-up which closely approximates Lord Rayleigh's was published by H. C. Lee, "Drop formation in a liquid jet," IBM Journal of Research and Development, July, 1974, pp. 364-369. Lee. Lee demonstrates that for a one-dimensional stream of infinite length, stream break-up requires a surface waveform, δ, which grows exponentially with time, t, for example:

$$\delta(\eta, t) = \delta_0 e^{\gamma t + \frac{2\pi\eta}{\lambda}}, \tag{1}$$

where $\eta = z - v_{j0}t$ is a coordinate transformation to a frame that is stationary with respect to the stream moving in the z-direction at velocity $v_{j0}$. $\delta_0$ is the initial amplitude of the surface wave at t=0, $2\pi/\lambda = 2\pi/LD_0$. γ is termed the growth factor and is a function of the surface tension, σ, and density, ρ, as well as the wavelength:

$$\gamma^2 = \frac{4\sigma}{\rho D_0^3}\frac{\pi^2}{L^2}\left(1 - \frac{\pi^2}{L^2}\right). \tag{2}$$

The growth factor has units of $sec^{-1}$.

The effects of viscosity have been omitted in the analysis expressed by Equations 1 and 2, i.e. the fluid is assumed to be inviscid. Viscosity has a dampening effect on the growth of the surface waves and, if included, would contribute a negative exponential term that diminished the effect of the positive growth factor term, γt. The inviscid fluid analysis used herein is appropriate for jetting liquid having a viscosity less than approximately 20 cpoise.

Figure 2:
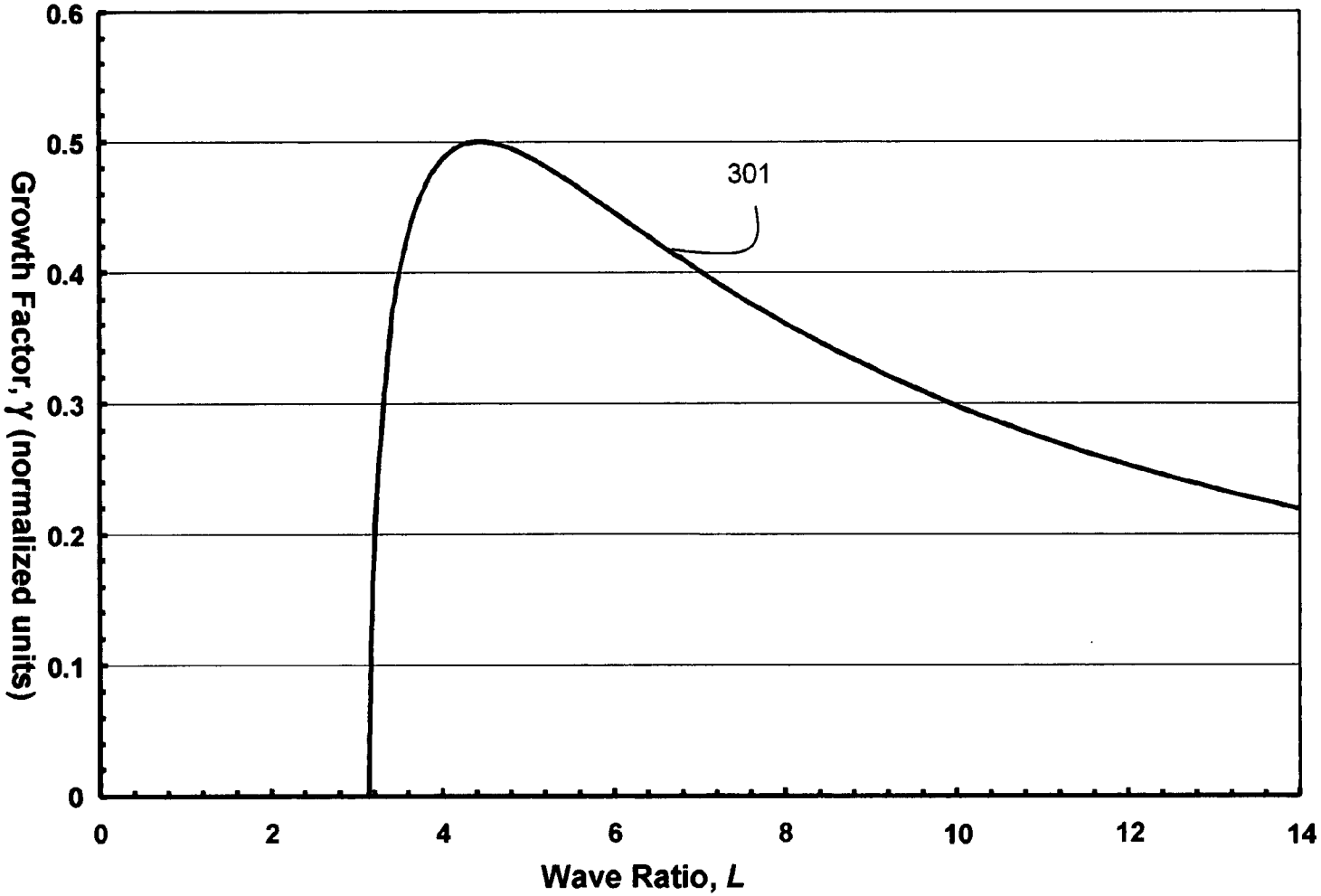
FIG. 2 provides a plot of the growth factor of surface waves on a jet stream versus the spatial wave ratio.

The growth factor γ is a representative measure of the probability of the stream breaking up at a particular wavelength $\lambda_0 = L_0 D_0$. That is, spontaneous surface waves having larger growth factors than others grow faster on the jet, leading more quickly to an amplitude $\delta(\eta,t) = \frac{1}{2}D_0$, pinching the jet off into drops. FIG. 2 shows a plot 301 of $\bar{\gamma}$ vs. L. $\bar{\gamma}$ is the normalized growth factor as defined in Equation 3:

$$\bar{\gamma}^2 = \gamma^2\frac{\rho D_0^3}{4\sigma} = \frac{\pi^2}{L^2}\left(1 - \frac{\pi^2}{L^2}\right). \tag{3}$$

The plot 302 of the normalized growth factor in FIG. 2 is useful in understanding the importance of the stimulation wavelength in designing a continuous liquid drop emitter.

Surface waves having wavelength ratios less than π have negative growth factors and so decay with time rather than grow to cause the jet to break up. The growth factor for a given fluid (σ and ρ) and nozzle diameter has a maximum value, $\bar{\gamma}=5.0$ at optimum wave ratio $L_{opt} = \pi\sqrt{2} = 4.443$ in Lee's one-dimensional analysis (Equations 1-3). By comparison, the more rigorous two-dimensional analysis by Lord Rayleigh produces a plot of the growth factor that appears nearly identical to FIG. 3 except that the maximum value is $\bar{\gamma}=4.8$ at $L_{opt}=4.51$. The growth factor rises quickly to its peak value from π and then more slowly falls off as L increases. Surface waves having L values of 10 or more may still result in drop break off. However, if spontaneous waves having a smaller wave ratio are present with equal or larger initial amplitude, they will grow much faster and lead to earlier jet break-up. The practice of synchronized continuous ink jet requires that a surface wave is stimulated at a chosen wave ratio and with sufficient amplitude to overwhelm the spontaneous surface waves that would otherwise lead to natural break-up.

As may be seen from Equation 2, the growth factor depends on the fluid surface tension, σ, the fluid density, ρ, and the jet or nozzle diameter, $D_0$, as well as the wave ratio, L. $\gamma_{max}$, occurring when the wave ratio is $L_{opt}$, is expressed in Equation 4:

$$\gamma_{\max}^2 = \frac{4\sigma}{\rho D_0^3}\frac{\pi^2}{L_{opt}^2}\left(1 - \frac{\pi^2}{L_{opt}^2}\right) = \frac{4\sigma}{\rho D_0^3}\frac{1}{4} = \frac{\sigma}{\rho D_0^3} \tag{4}$$

Figure 3:
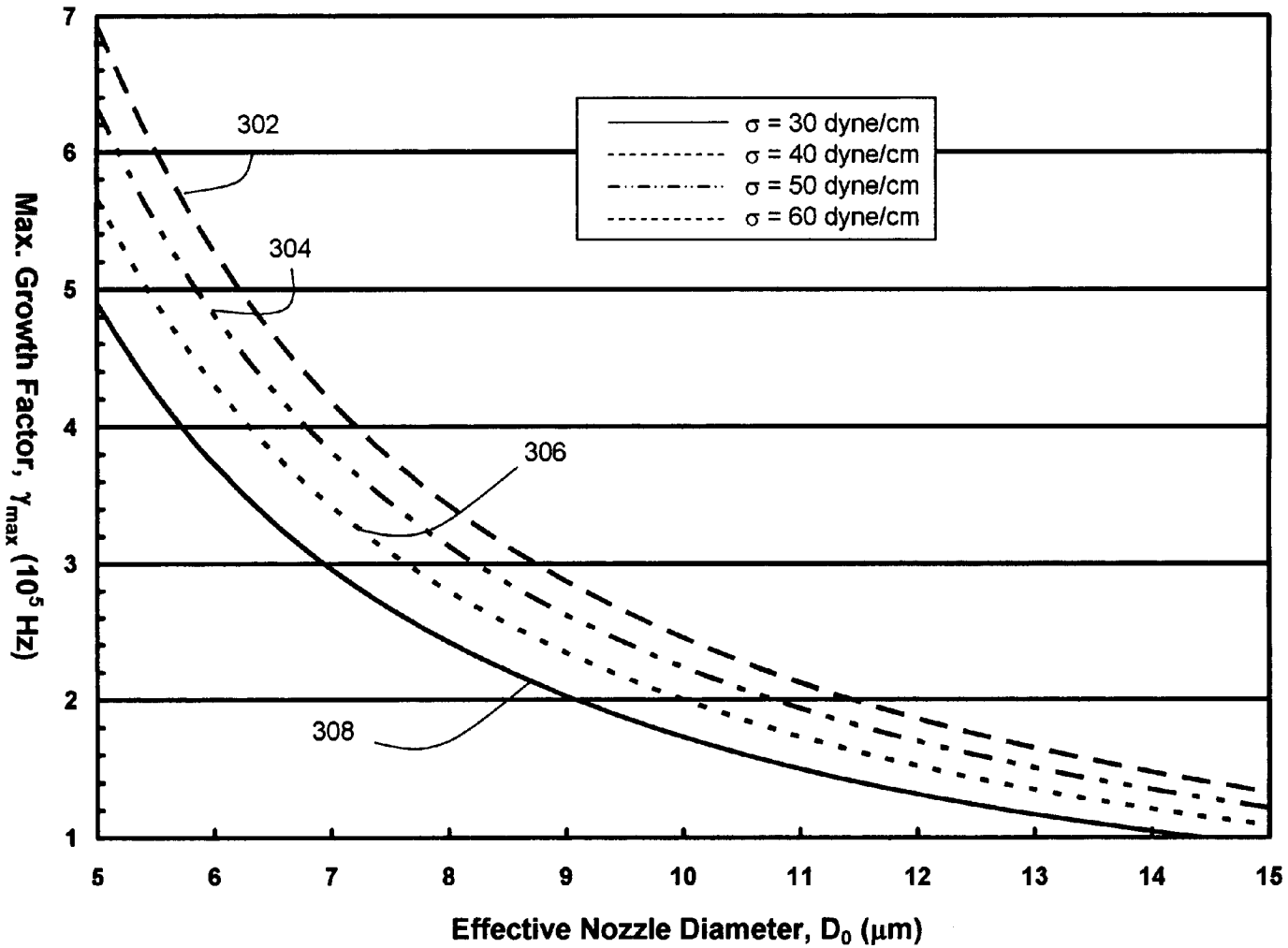
FIG. 3 provides a plot reflecting maximum surface wave growth factor versus the spatial wave ratio for three values of the liquid surface tension.

The maximum growth factor according to Equation 4 is plotted in FIG. 3 versus effective nozzle diameter, for four values of the surface tension, σ=30, 40, 50, or 60 dyne/cm. and for a liquid with density ρ=1 gm/cm$^3$, plots 308, 306, 304 and 320 respectively. The liquid property values are appropriate for an aqueous working fluid, for example, an aqueous ink jet ink. The maximum growth factor, $\gamma_{max}$, has units of $sec^{-1}$ (Hz) and has a magnitude of $10^5$ over the nozzle diameter range plotted in FIG. 3: 5 μm≦$D_0$≦15 μm. The growth factor may also be expressed as a growth time constant $\tau=1/\gamma$. For the parameters used for FIG. 3, the growth time constant, τ, therefore has a magnitude range of approximately: 1.5<τ<10 μsecs.

It may be appreciated from FIG. 3 that the growth factor is weakly dependent on liquid surface tension over a practical range for aqueous systems, and more strongly dependent upon nozzle diameter. The focus of the present inventions is upon liquid pattern deposition systems that deposit very small drops for very high image or pattern quality. Consequently, the strong dependence of the growth factor on nozzle diameter, for nozzles smaller than about 12 μm, is a critical consideration in designing an optimum system. Uncontrolled variations in the diameters of nozzles within an array of nozzles will lead to significant variations in the growth factors for surface waves from jet-to-jet and, therefore, undesirable variations in jet stream break-up from jet-to-jet. Typically, the techniques for the manufacture of commonly practiced CIJ nozzle arrays, for example the technique of electroforming nozzles, result in large variations of nozzle diameters and shapes compared to the variations characteristic of newly developed techniques, such as MEMS manufacturing technologies. A lack of a precise analysis of the implications of new manufacturing techniques has precluded provision of high speed, high quality CIJ nozzle arrays.

The effect of growth factor differences on the actual magnitude of the surface waves is illustrated by the plots 310, 312, 314, and 316 of a normalized surface wave amplitude $\bar{\delta}(0,t)$ for some different values of γ arising from some different values of L, and $D_0$, for a fluid having σ=50 dyne/cm and ρ=1 gm/cm³.

$$\bar{\delta}(0,t)=\frac{\delta(0,t)e^{\gamma t}}{\delta_0}=e^{\gamma t}, \tag{5}$$

where $\eta=z-v_{j0}t=0$ is equivalent to examining the growth of the surface wave as one moves along with the stream. Equation 5 is plotted in FIG. 4 on a semi-$\log_{10}$ scale so that the normalized surface wave amplitude versus time is a straight line having slope $\gamma\log_{10} e$. Plots 310 and 312 are for $D_0$=6 μm and $L=L_{opt}$ and L=10, respectively. Plots 314 and 316 are for $D_0$=10 μm and $L=L_{opt}$ and L=10, respectively.

Figure 4:
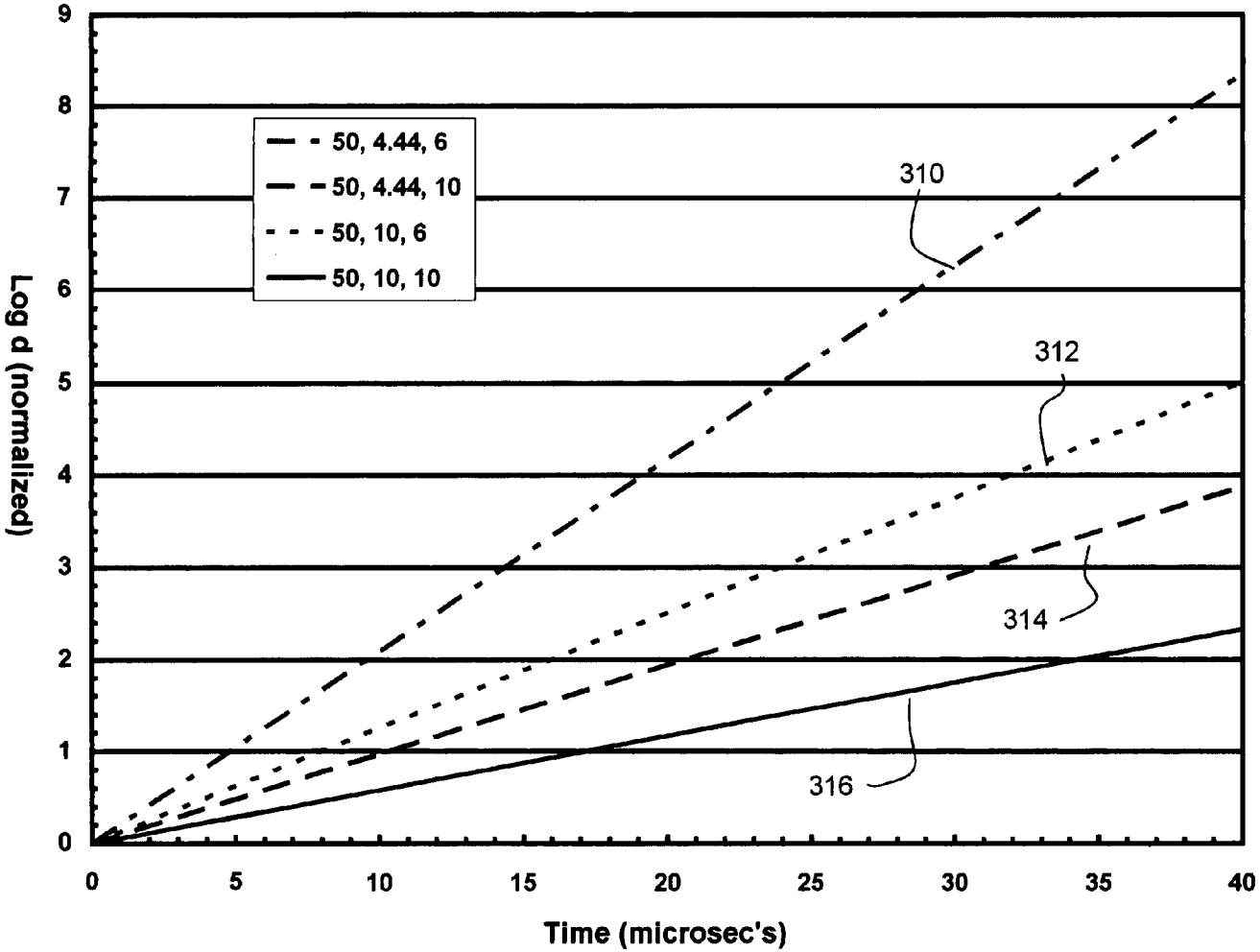
FIG. 4 provides a plot reflecting the normalized amplitude of surface waves versus time for different combinations of surface tension, wave ratio and jet diameter.

The plots of FIG. 4 show the large range in value of the normalized surface wave amplitude that may develop in a few 10's of microseconds for jets in this parameter range. For example, after only 20 microseconds, the range in surface wave growth is approximately three orders of magnitude. After 40 microseconds the range is 6 orders of magnitude such a range of variations would appear to restrict the ability to operate arrays of CIJ nozzles for high speed, high quality deposition of materials in the absence of critical analyses of the currently practiced manufacturing capabilities. For example, a surface wave stimulation, $\delta_0$, added to a 6 μm diameter jet having the optimum wave ratio, L=4.443, will grow to be a million times larger than a surface wave of the same initial amplitude, $\delta_0$, added to a 10 μm diameter jet at a wave ratio of L=10. The plots of FIG. 4 also illustrate that influence of wave ratio on surface wave growth is stronger as the nozzle diameter is reduced, i.e. plots 310 and 312 diverge from each other more than plots 314 and 316 do. In the absence of critical analyses of the currently practiced manufacturing capabilities, such variations appear restrictive for the provision of the very small drop volumes required for high speed, high quality material deposition.

Finally, it may be appreciated from FIG. 4 that to purposefully stimulate a jet stream to break up into drops of a chosen volume and frequency requires only small initial disturbance amplitude, $\delta_0$, especially for the smallest nozzles. For example, if the initial disturbance magnitude is only 1% of the stream diameter, then this will grow to equal the stream diameter, hence synchronized drop break-up, within only 10 microseconds for the case of plot 310, or within ~35 microseconds for the case of plot 316. The consistency of drop formation is thus seen from FIG. 4 to be sensitive to variations in the parameters of drop stimulation as well as nozzle diameter, for example to the uniformity of acoustic or thermal perturbations from nozzle to nozzle or during operation. Uncontrolled variations in the magnitude or phase of the stimulation parameters within an array of nozzles will lead to significant variations in the growth factors for surface waves from jet-to-jet and, therefore, undesirable variations in jet stream break-up from jet-to-jet. Newly developed technologies, such as MEMS manufacturing technologies have been analyzed by the inventors of the present inventions in regard to their ability for provision of high speed, high quality CIJ nozzle arrays.

As will be explained further below, a high quality liquid pattern deposition system design begins with choosing an appropriate target drop volume. The nozzle diameter and wave ratio are the two design factors that determine drop volume. As may be appreciated from FIG. 4, these are also important factors in determining the effectiveness of the applied stimulation via the growth factor. An overall system optimization therefore will seek to balance or optimize the performance factors of drop volume and drop break-up stimulation.

FIG. 1(*b*) also illustrates a stream of drops of predetermined volumes 110 that is breaking off at 76, a predetermined, preferred operating break-off length distance, $BOL_0$. While the stream break-up period is determined by the stimulation wavelength, the break-off length is determined by the intensity of the stimulation. The dominant surface wave initiated by the stimulation thermal pulses grows exponentially until it exceeds the stream diameter. If it is initiated at higher amplitude the exponential growth to break-off can occur within only a few wavelengths of the stimulation wavelength. Typically a weakly synchronized jet, one for which the stimulation is just barely able to become dominate before break-off occurs, break-off lengths of ~12 $\lambda_0$ will be observed. The operating break-off length illustrated in FIG. 1(*b*) is 8 $\lambda_0$. Shorter break-off lengths may be chosen and even BOL ~1 $\lambda_0$ is feasible, especially for smaller nozzles, as may be appreciated from FIGS. 3 and 4.

In choosing the break-off length to be used in the design of a high-speed, high quality materials deposition systems, it is important to analyze the manufacturing parameters that control the intensity of the thermal stimulation as well as those that control the growth rate of the perturbations; because, just as in the case of the variations in growth rate due to the sensitivity of growth rate to the design parameters shown in FIG. 3, break-off lengths deviating from those desired can occur due to the sensitivity of break-off length to variations in the ability of the heaters to transfer heat energy to high velocity fluid jets flowing through the nozzles. Such variations include variations in the transistor characteristics which regulate heater drive currents, which have been analyzed previously and whose design rules are well known, and variations in the heat transfer characteristics between the heaters and the fluid jets as governed by the precision of the manufacture of the heating elements and their placement with respect to the nozzles. These variations have not heretofore been analyzed. Generally, such variations are detrimental to high quality images when their effects cause systems parameters such as the consistency of break-off lengths to vary by more than a few percent.

The uses contemplated for the devices disclosed by Drake are limited by the variations in the dimensions and locations of the heaters and the range of temperatures over which the heaters can be operated. An analysis based on current electronic design rules is required to reveal practicable ranges for the operation of high speed, high quality CIJ operation. For example, variations in the size and film thicknesses of the heaters and variations of their placement with respect to the nozzles fabricated by MEMS technologies must be carefully considered for the very small nozzles associated with the small drops required for high quality deposition of material.

Furlani, in J. Phys. A: Mathematical and General, 38, (2005) 263-276, (Furlani hereinafter) provides an approximate formula analogous to Eq. 1 (from Lee) evaluated at the minimum jet radius, but for the case of thermal stimulation, given as:

$$\delta(\eta, t) = \frac{\Delta\sigma}{\sigma}\frac{L^2}{(L^2-\pi^2)}\left[1+\frac{\alpha_-}{\alpha_+-\alpha_-}e^{\alpha_+ t}-\frac{\alpha_+}{\alpha_+-\alpha_-}e^{\alpha_- t}\right]. \tag{6}$$

Here, $\Delta\sigma$ is the initial change induced in surface tension by the heater as the jet exits the nozzle. The growth factors in Equation 6, analogous to $\gamma$ in Equation 1, are given by:

$$2\alpha_\pm = -\frac{3\mu}{\rho}\left(\frac{2\pi}{LD_0}\right)^2 \pm \sqrt{\left\{\left[\frac{3\mu}{\rho}\left(\frac{2\pi}{LD_0}\right)^2\right]^2+4\beta^2\right\}}, \tag{7}$$

where $$\beta = \frac{4\sigma\pi^2}{\rho L^2 D_0^3}\left(1-\frac{\pi^2}{L^2}\right). \tag{8}$$

Comparing Equations 1, 6, 7, and 8, the initial thermal perturbation magnitude, the pre-factor to the exponential in Equation 6, can be identified as:

$$\delta_0 \cong \frac{D_0}{4}\left(\frac{\Delta\sigma}{\sigma}\right)\frac{L^2}{2(L^2-\pi^2)}, \tag{9}$$

where, for simplicity of discussion, the approximation of low viscosity has been used in Equations 7 and 8, and the Rayleigh number has been taken as $L_{opt}$, These approximations for simplicity of discussion are not required for the conclusions of the analysis herein and should not be followed for rigorous understanding of the deposition of highly viscous liquids.

$\Delta\sigma$ is the change in surface tension, $\sigma$, at the nozzle bore. For thermal stimulation, this change is related to the surface temperature rise; which, by way of example, is computed to be approximately 0.1° K for the parameter set: $\{\gamma^{-1}=2.6$ microseconds, $D_0=10$ microns, and BOL=300 microns$\}$, and using an average value for the temperature coefficient of surface tension for aqueous fluids. That is, the surface tension of many aqueous base materials typically changes by approximately 1 percent for a temperature rise of approximately 5° K. The exact values of the temperature coefficient of surface tension may be used for any particular liquid deposition material used with the present inventions.

Figure 5:
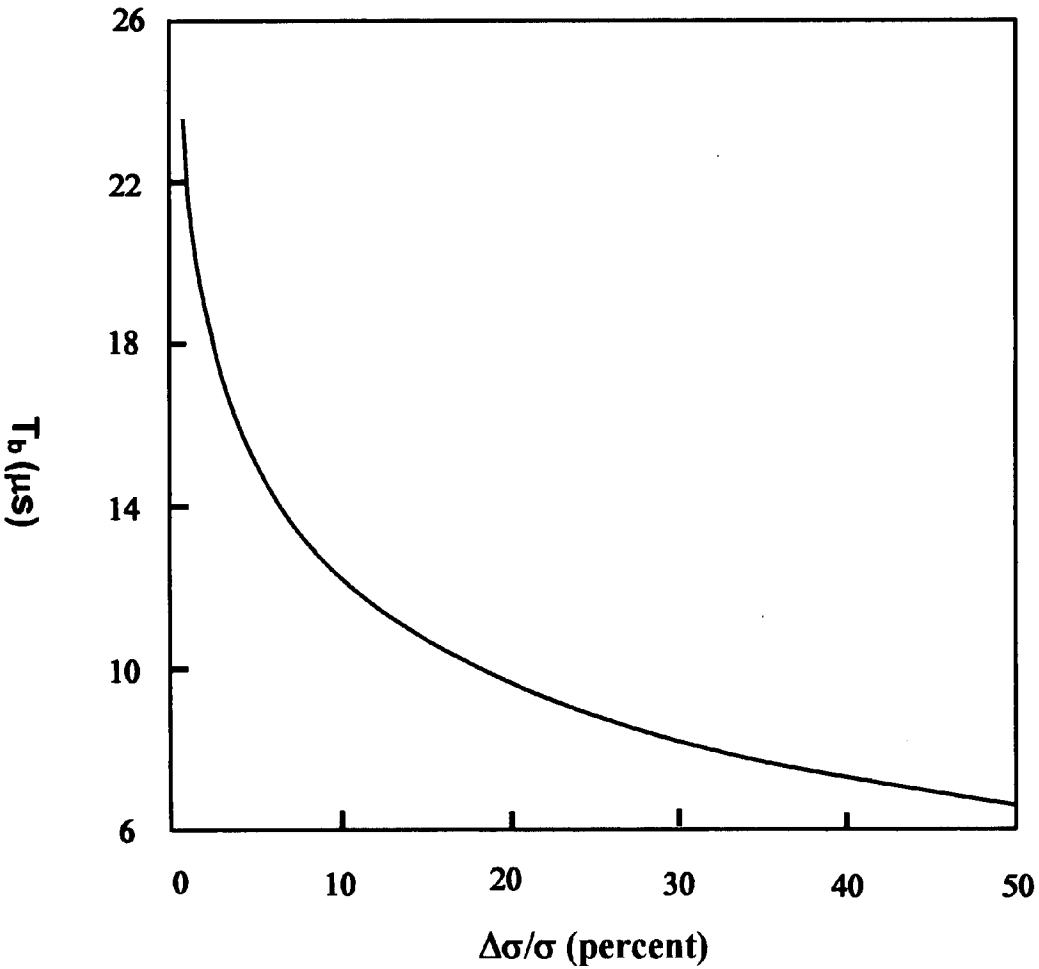
FIG. 5 provides a plot of drop break-off time versus percent variation in initial surface tension of a jet exiting a nozzle for the case of thermal stimulation from the reference of E. Furlani.

FIG. 5, reproduced from Furlani, plots the dependence of break-off time, $T_b$ as a function of the initial stimulation as a percentage of the nominal surface tension. Break-off length, BOL, is the product of break-off time, $T_b$, and the jet velocity, $v_{j0}$. i.e. BOL=$T_b v_{j0}$. The steep reduction of break-off time with stimulation magnitude is typical of small thermal perturbations required to prevent boiling, which would occur for the parameters in the example at about a 1% variation in FIG. 5. The sensitivity of break-off time to stimulation shown in FIG. 5 means that small changes in the fractional stimulation can alter the break-off lengths causing a distribution of BOL's in excess of that desired for large arrays of drop emitters. For example, a change in break-off time of 2 microseconds, causes a 40 micron change in BOL for a fluid jet having a velocity of 20 m/s. This amount of variation in BOL from nozzle-to-nozzle, or among groups of nozzles in a large jet array, is generally considered to be at the upper limit acceptable for optimal operation of an electrostatically deflected CIJ printhead.

The quantitative influence of MEMS fabrication parameters on the variation of break-off length can be understood by approximating the flow of heat from a heater to the fluid jet as a one-dimensional thermal diffusion problem in which an energy pulse from a heater diffuses through an insulator material toward the jet, the energy flux, J, at a distance x, from the heater having the well known form:

$$J = \left(\frac{Q}{\rho C_p}\right)\left(\frac{k}{\kappa t}\right)\sqrt{\frac{x^2}{4\pi\kappa t}}\, e^{-\frac{x^2}{4\kappa t}}, \tag{10}$$

where k is the thermal conductivity, $\rho$, the density, $C_p$, the heat capacity at constant pressure; $\kappa$ is the thermal diffusivity ($\kappa=k/\rho C_p$) of the insulator material; and t is the time. Q is the amount of heat in the energy pulse, assumed to be spatially highly localized at t=0.

The maximum heat flux, $J_{max}$, arriving at the nozzle located a distance $x_0$ away from the location of the initial heat energy, occurs at approximately the diffusion time, $t_D=x_0^2/\kappa$. $J_{max}$ varies inversely as the square of the distance of the heater to the nozzle, as would be expected to be also the spatial dependence of the variation of the energy delivered by the pulse to the jet to form each drop and assuming the energy must be delivered in a fixed time window to the moving fluid jet in order to ensure break-up regardless of the distance of the heater to the nozzle. Therefore, we approximate $J_{max}$ as follows $$J_{\max} \cong \left(\frac{Q}{\rho C_p}\right)\sqrt{\frac{27}{2\pi e^3}}\left(\frac{k}{x^2}\right). \tag{11}$$

From the above equations, we estimate various fractional changes, $\delta_i$, in $\Delta\sigma/\sigma$, as plotted in FIG. 5, due to various design rules of state-of-the-art MEMS fabrication processes.

For example, if the heater-to-bore placement distance of the design of a particular thermally stimulated CIJ array is a distance $z_1$, and the design rules for the fabrication processes specify a design tolerance variation of an amount $x_1$ for the distance $z_1$ then the relevant fractional change, $\delta_1$, in $\Delta\sigma/\sigma$, is given approximately as:

$$\delta_1\left(\frac{\Delta\sigma}{\sigma}\right) = 6\left(\frac{x_1^2}{z_1^2}\right). \tag{12}$$

In Equation 12, it is assumed that the nozzle bore is rectangular, having a length and a width, with heaters located along the length direction adjacent each side of the bore and spaced ideally a distance $z_1$ from the edges of the bore, as is appropriate for some types of thermally stimulated CIJ drop emitters.

Typical mask-mask alignment tolerances are in the range 0.1-2.0 microns for many MEMS processes for heater and bore formation, depending on whether masks are made on the same or opposite sides of the substrates, and other processing factors. Typical heater-to-bore distances lie in the range of from 0.1 to 4.0 microns, depending on the fluid parameters of the materials to be jetted. From such design specifications and process design rules, the expected variations in break-off times for drop formation and hence the expected variations of break-off lengths may be determined from the plot of FIG. 5. For CIJ arrays for high-speed, high-quality deposition of materials, variations of more than about 10-20 microns in break-off length among nozzles or groups of nozzles should be avoided, as has been previously discussed. For other bore designs, for example circular bores, formulas similar to Equation 12 may be derived, for example using cylindrical coordinates and as discussed in Carslaw and Jaeger, "Conduction of Heat in Solids, Chapter 13, Oxford University Press, in which case the formulas can be expressed in terms of Bessel functions and their derivatives. While computational models exist to find numerical values for arbitrary heater geometries, such models are time consuming and cumbersome and provide little guidance for providing CIJ arrays for high-speed, high quality CIJ materials deposition.

Account may also be taken of the design rules for the linewidths of deposited and etched materials critical to CIJ drop formation, for example heater resistor materials. For heaters having a width ideally specified as width $z_2$, and a perimeter distance much longer than $z_2$, then the fractional change, $\delta_2$, in $\Delta\sigma/\sigma$, as plotted in FIG. 5, may be approximated as:

$$\delta_2\left(\frac{\Delta\sigma}{\sigma}\right) = \left(\frac{x_2}{z_2}\right). \tag{13}$$

Here, $x_2$ is the expected process variation of $z_2$, due, for example, to a linewidth variation resulting from etching of the heater resistor material. The formula expressing a third potential fractional change, $\delta_3$, is of an identical form to Equation 13, for a case wherein the heater thickness processing tolerance is $x_3$ and the ideal heater thickness is $z_3$. As is well known, all the design rules discussed contribute independently to the total variation in break-off times for drop formation and hence for the expected variations of break-off lengths as determined from the plot of FIG. 5. Typical linewidth tolerances for etching of heater materials lie in the range of 0.1-1.0 microns for many MEMS processes and heater materials while typical heater widths lie in the range of from 0.5 to 4.0 microns. Heater thicknesses typically are from 0.05 to 2.0 microns and the variations in those thicknesses reflected in process design rules are typically 0.01 to 0.2 microns. The effect of design rules on break-off lengths can thus be quite large for certain parameter combinations.

From these equations, it may be seen that for efficient energy transfer, i.e. when the heater is close to the bore, and for high density arrays, with consequently small diameter nozzles and small heater widths, the sensitivity of heat transfer to the design rules increases. However, it is fortunate in the latter case of small diameter nozzles, that the growth parameter, $\gamma$, in Equation 1 is large, which somewhat mitigates the sensitivity of break-off length variations to changes in the stimulation parameter, as can be seen in below Equation 14. Taking the derivative of Equation 1 and expressing the break-off length, BOL, in terms of the break-off time, $T_b$, and jet velocity, $v_{j0}$, it is found:

$$\frac{\delta(BOL)}{\partial\delta_0} = -\frac{v_{j0}}{\delta_0\gamma}. \tag{14}$$

A critical analysis of the currently practiced manufacturing capabilities avoids design the many design variations that restrict the provision of the very small drop volumes required for high speed, high quality material deposition.

Figure 6:
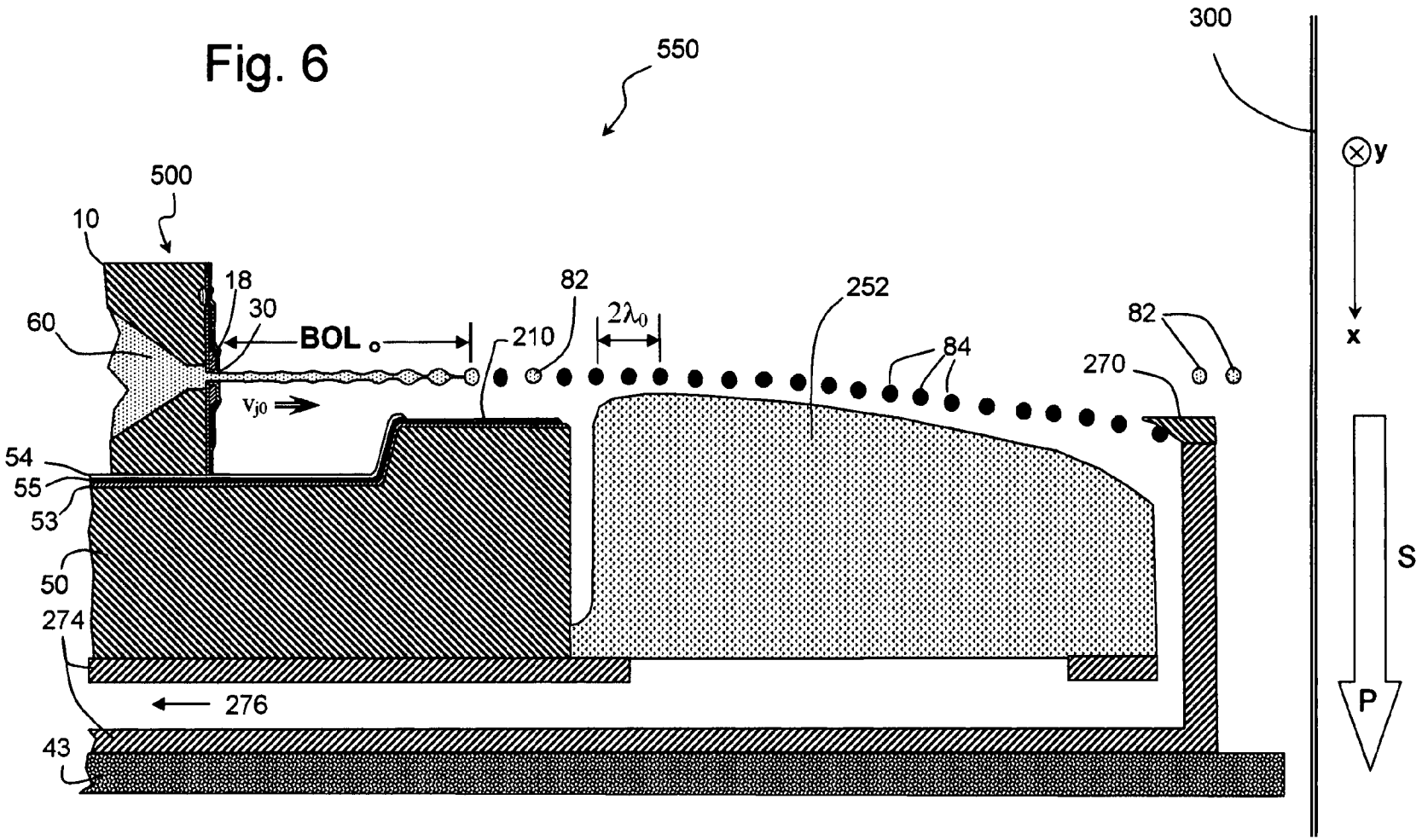
FIG. 6 is a side view illustration of a thermally stimulated edgeshooter style drop emitter further illustrating drop charging, deflection, guttering apparatus and deposition on a receiver according to the present inventions.

FIG. 6 illustrates in side view a preferred embodiment of the present inventions that is constructed of a multi-jet drop emitter 500 assembled to a substrate 50 that is provided with inductive charging apparatus 210. Only a portion of the drop emitter 500 structure is illustrated in that only a portion of the pressurized fluid supply manifold is illustrated and the fluid supply connection is not illustrated. FIG. 6 may be understood to also depict a single jet drop emitter according to the present inventions as well as one jet of a plurality of jets in multi-jet drop emitter 500. Further, drop emitter 500 in FIG. 6 comprises the same components as are illustrated for drop generator 500 in FIGS. 1(*a*) and 1(*b*).

Substrate 50 supports an inductive drop charging apparatus comprising charging electrode 210 configured to have an individual electrode for each jet of multi-jet drop emitter 500 so that the charging of individual drops within individual streams may be accomplished. An electrical charging electrode contact lead 55 is illustrated that connects to charging electrode 210 and is protected by insulating layers 53 and 54. Insulating layer 54 may also serve as a bonding layer to bond drop generator 500 to the charging electrode substrate 50. The full drop emission system structure 550 is truncated on the left-hand side of FIG. 6 so that external electrical connections to charging electrode contact lead 55 are not shown.

Also illustrated in FIG. 6 are additional elements of a complete liquid drop emission system 550. Drop emitter 500, with inducting charging electrode 210, is further assembled with a ground-plane style drop deflection apparatus 252, drop gutter 270 and drop emission system support 42. Gutter liquid return manifold 274 is connected to a vacuum source (not shown indicated as 276) that withdraws liquid that accumulates in the gutter from drops tat are not used to form the desired pattern at receiver plane 300.

Ground plane drop deflection apparatus 252 is a conductive member held at ground potential. Charged drops flying near to the grounded conductor surface induce a charge pattern of opposite sign in the conductor, a so-called "charge image" that attracts the charged drop. That is, a charged drop flying near a conducting surface is attracted to that surface by a Coulomb force that is approximately the force between itself and an oppositely charged drop image located behind the conductor surface an equal distance. Ground plane drop deflector 252 is shaped to enhance the effectiveness of this image force by arranging the conductor surface to be near the drop stream shortly following jet break-off. Charged drops 84 are deflected by their own image force to follow the curved path illustrated to be captured by gutter lip 270 or to land on the surface of deflector 252 and be carried into the vacuum region by their momentum. Ground plane deflector 252 also may be usefully made of sintered metal, such as stainless steel and communicated with the vacuum region of gutter manifold 274 as illustrated. Uncharged drops 82 are not deflected by the ground plane deflection apparatus 252 and travel along an initial trajectory toward the receiver plane 300 as is illustrated for a two drop pair 82.

The various component apparatus of the drop emission system 550 are not intended to be shown to relative distance scale in FIG. 6. In practice a Coulomb deflection apparatus, such as the ground plane type 252 illustrated, would be much longer relative to typical stream break-off lengths and charging apparatus in order to develop enough off axis movement to clear the lip of gutter 270.

Figure 7:
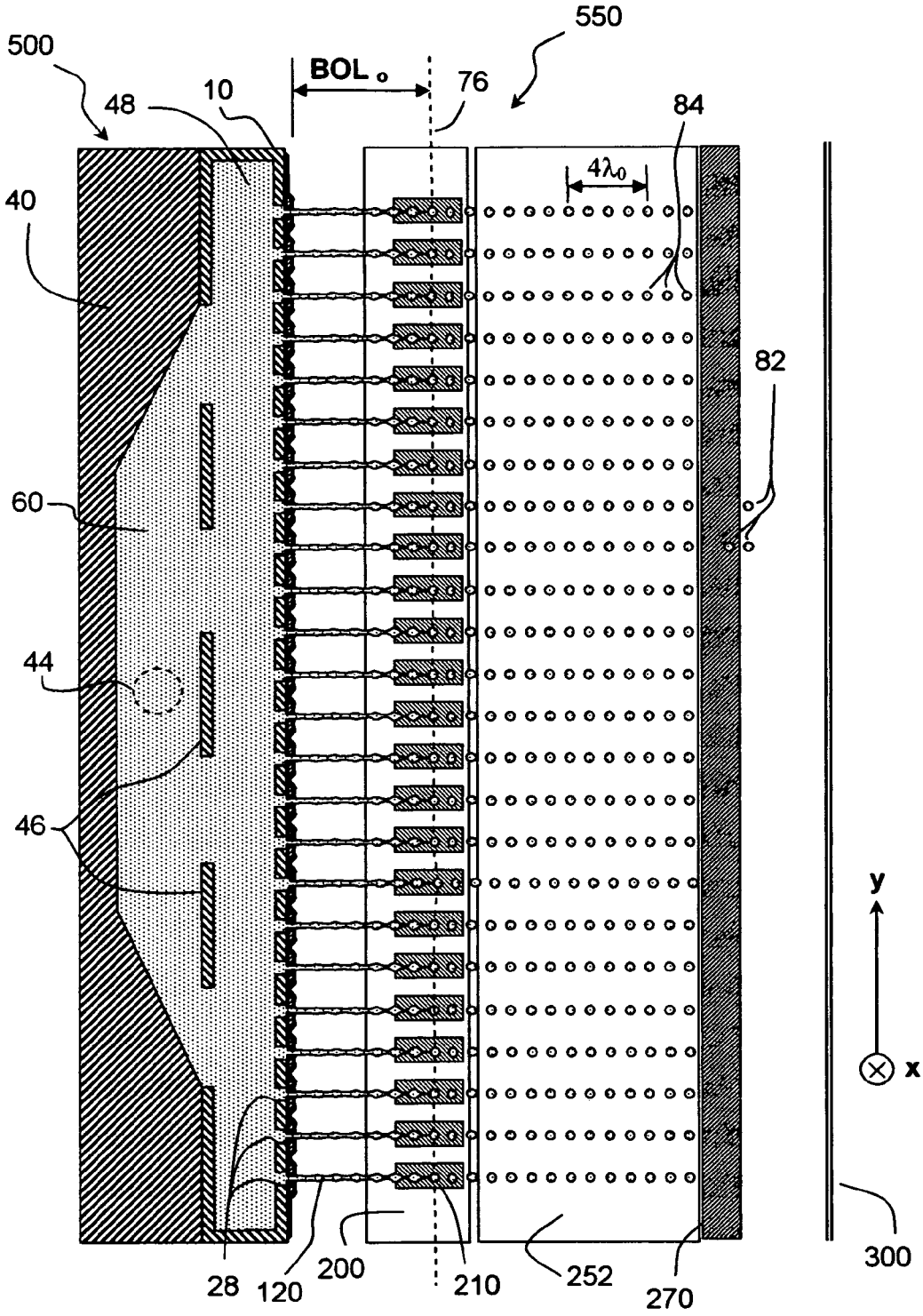
FIG. 7 is a top side view illustration of a drop emitter array having a plurality of liquid streams and having drop charging, deflection and gutter drop collection apparatus according to the present inventions.

FIG. 7 depicts in top sectional view a drop emission system 550 according to the present inventions wherein the inductive charging apparatus 200 comprises a plurality of charging electrodes 210, one for each jet stream 120. The construction of the drop emitter portion 500 is similar to that shown in cutaway side view in FIG. 1(*b*). A ground plane deflection member 252 and gutter 270 are constructed in similar fashion to those of FIG. 6. Charged drops 84 are deflected by electrostatic image forces into gutter 270. Uncharged drops 82 fly to the media or receiver surface 300.

For this example the liquid deposition pattern is formed along the jet array axis direction by the uncharged drops that are allowed to strike the receiver surface 300 from each jet. The receiver 300 and liquid drop emitter 550 are moved relative to each other in a direction crossing the jet array direction so that the liquid pattern may be formed in that direction by the selection in time of which drops are allowed to strike the receiver from each jet of the array. In this fashion the liquid pattern may be formed in units of one drop and in spatial increments determined by the jet spacing, drop break off timing, and the relative velocity of the liquid drop emitter 550 and receiver surface 300.

Figure 8:
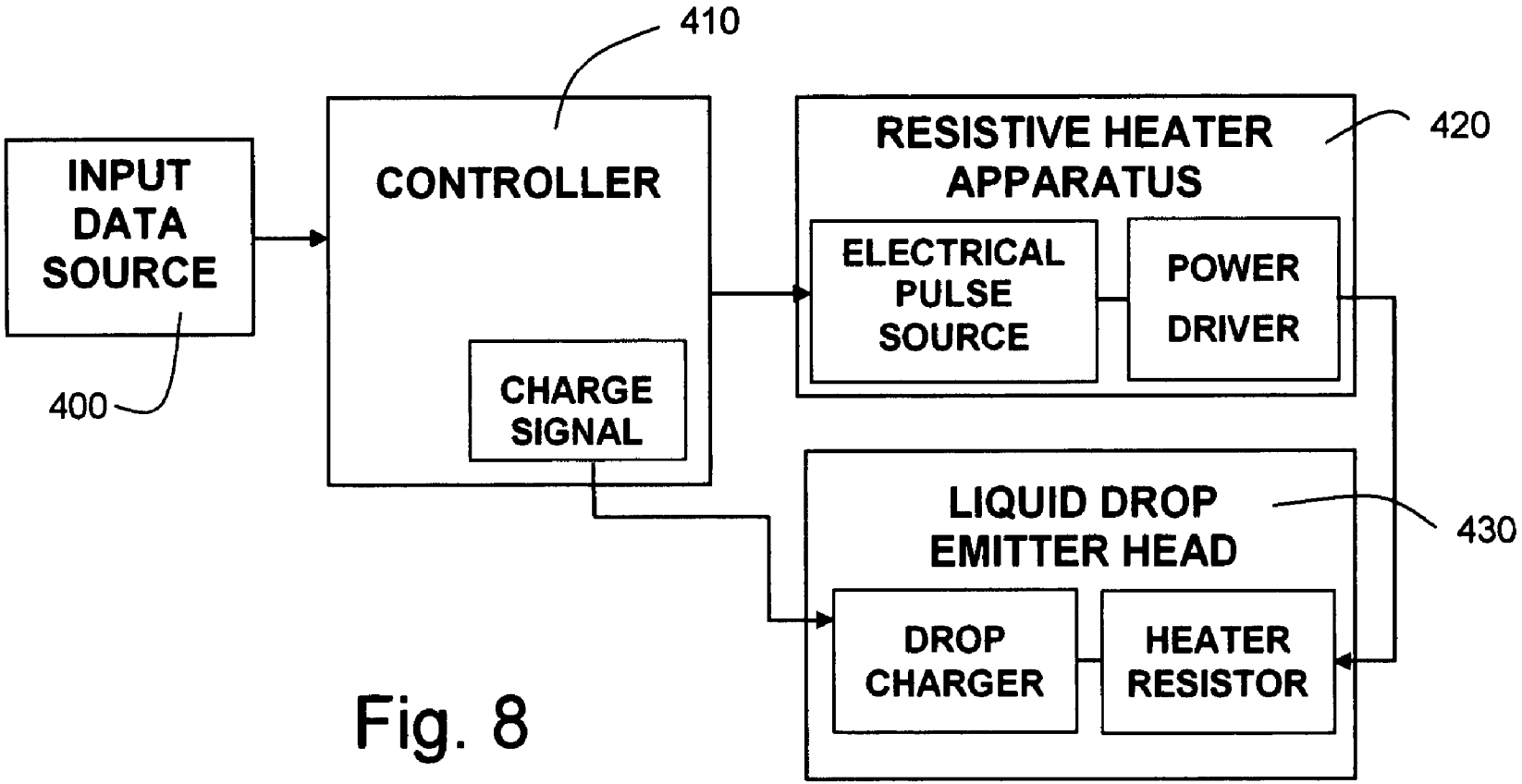
FIG. 8 illustrates a configuration of elements of a drop deposition control apparatus according to the present inventions.

FIG. 8 illustrates in schematic form some of the electronic elements of a control apparatus according to the present inventions. Input data source 400 represents the means of input of both liquid pattern information, such as an image or functional material layer, and system or user instructions.

Controller 410 represents computer apparatus capable of managing the drop emission system. Specific functions that controller 410 may perform include determining the timing and sequencing of electrical pulses to be applied for stream break-up synchronization, the energy levels to be applied for each stream of a plurality of streams to manage the break-off length of each stream and drop charging signals.

Resistive heater apparatus 420 applies pulses of thermal energy to each stream of pressurized liquid sufficient to cause Rayleigh synchronization and break-up into a stream of drops of predetermined volumes, $V_0$ and, for some embodiments, $mV_0$, where m is an integer. Resistive heater apparatus 420 is comprised at least of circuitry that configures the desired electrical pulse sequences for each jet and power driver circuitry that is capable of outputting sufficient voltage and current to the heater resistors to produce the desired amount of thermal energy transferred to each continuous stream of pressurized fluid.

Drop emitter 430 is comprised at least of heater resistors in close proximity to the nozzles of a multi-jet continuous fluid emitter and charging apparatus for some embodiments.

The arrangement and partitioning of hardware and functions illustrated in FIG. 8 is not intended to convey all of many possible configurations of the present inventions.

Figure 9:
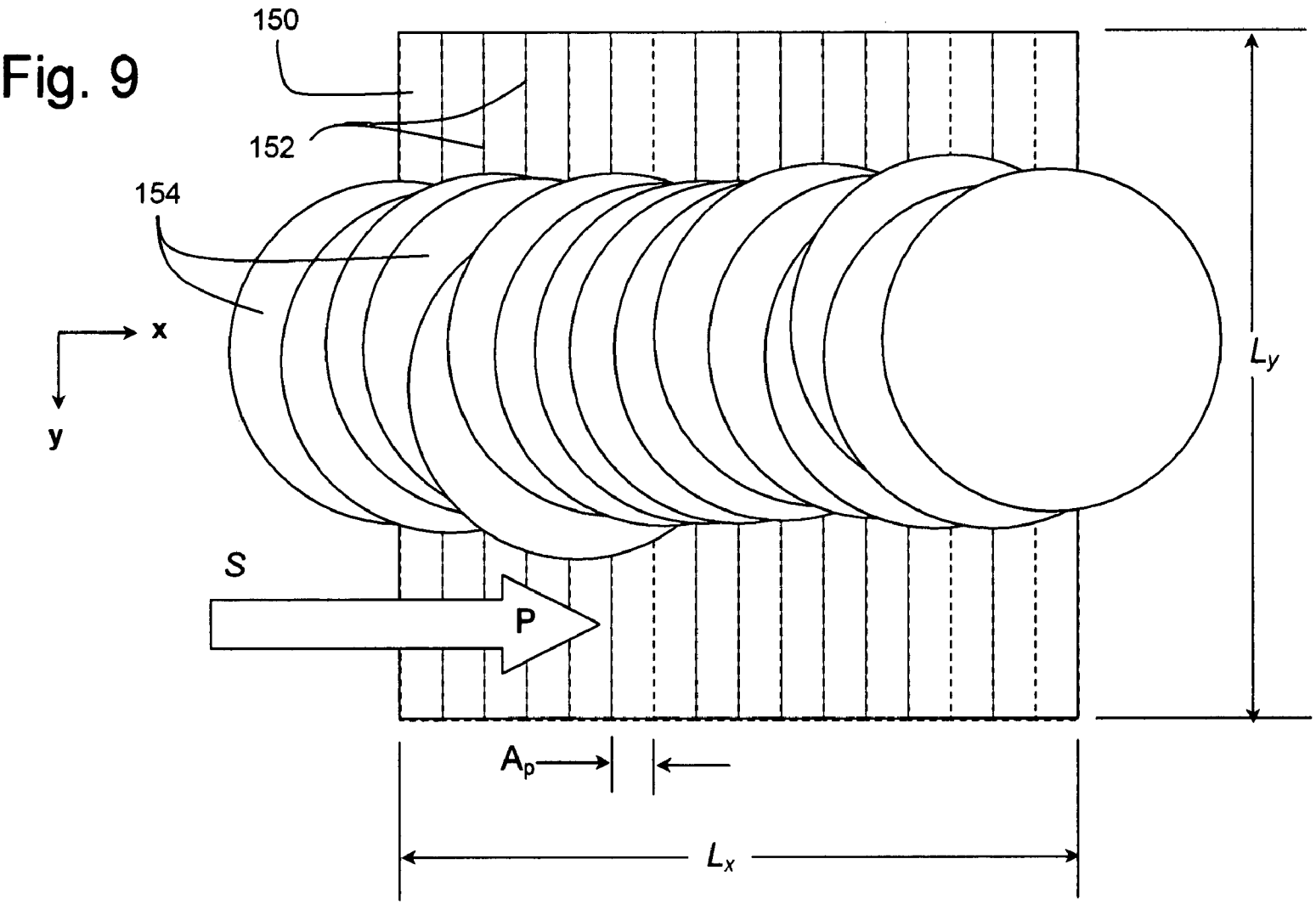
FIG. 9 illustrates the deposition of 16 drops in a single pattern cell according to the present inventions.

The formation of a liquid pattern according to the present inventions is illustrated in FIG. 9. The liquid patterns are composed of spots 154 of unit liquid volume, $V_0$, deposited on a two-dimensional spatial grid. For simplicity of understanding the spatial grid is assumed herein to be rectangular, having one axis oriented along the direction of the array of nozzles, i.e. the y-axis in FIG. 7. A perpendicular x-axis is oriented in the direction of relative motion of the drop emitter and the receiver surface, indicated as downward in FIG. 6 and into the page in FIG. 7. In FIG. 9, an area 150 of the liquid pattern, commonly referred to as a picture element or "pixel" for image patterns, is the smallest element of the pattern. The terms "pixel" and "pattern cell" will be used interchangeably herein to designate the smallest pattern element. The single rectangular pixel 150 illustrated in FIG. 9 has a length along the x-direction of $L_x$ and $L_y$ in the y-direction.

Very high quality image printing or functional material patterning may be created using continuous drop emitters according to the present inventions by causing the deposition of multiple drops, N, along the process direction, P, the direction of emitter/receiver relative motion, i.e. the x-axis in FIG. 9. Multiple potential drop depositions, for example, N=16, are illustrated by the sixteen circular spots 154 whose centers are caused to fall within pixel 150. Because of the high frequency drop generation capability of the Rayleigh break-up process such high multiple drop per pixel deposition processes are feasible. FIG. 9 illustrates that individual spot centers may be placed within a pixel along the process direction with a fine spacing, termed herein the process direction addressability, $A_p$. The drop emitter and receiver are moved with respect to each other at process speed, S.

For the example of FIG. 9, the process direction addressability is 1/16th of the x-direction pixel length, i.e. $A_p=L_x/N=L_x/16$. To carry out the deposition process illustrated, the drop generation frequency, $f_0$, has to be high enough to keep up with the process speed and the multiple drops/pixel that may be potentially applied. That is, $$f_0 \geqq S/A_p = SN/L_x. \tag{15}$$

The parameter N, the potential drops per pixel area 150 is an important determiner of the quality of the pattern that can be deposited. For images it represents a number of grey levels, densities of colorant, which may be deposited in each pixel cell. For functional material patterns, it represents the incremental amount of liquid that may be metered to each pixel location.

The present inventions are directed at forming very high quality images and functional material patterns consistent with adequate control for this purpose of the drop formation properties across large printheads. Therefore, the maximum values for $L_x$ and $L_y$ contemplated are 1/300th inches or ~85 microns, i.e. $L_x$, $L_y$<85 μm. Also the minimum value of addressable drops per pixel contemplated is N=16, when $L_x=L_y\approx 85$ μm.

For a system wherein the receiver 300 and drop emitter system 550 pass by each other one time, termed "single pass" printing, the spacing between nozzles establishes a minimum value for $L_y$, the pixel width perpendicular to the process direction. For single pass printing therefore, the present inventions contemplate that the effective nozzle spacing must less than 85 μm. The effective nozzle spacing may be achieved by using a plurality of interdigitated rows of jets. Additionally, if a deflection system is implemented to deflect the drops in the nozzle array direction, then a given nozzle can contribute drops to more than one pixel area, and the nozzle spacing may be increased as long as the drop frequency is increased accordingly.

High quality image printing and functional material patterning also requires that a proper thickness of liquid be delivered to fully coated areas. For imaging applications, this requirement translates into needing to deposit a certain mass of colorant dye molecules or pigment particles per unit area to absorb enough light to achieve a pleasing optical density, typically above 1.0 OD and, more desirably, above 1.2 OD. The present inventions contemplate that the viscosity of the liquid will be less than 20 cpoise. This requirement, and the difficulty of dissolving or suspending large weight concentrations of colorant in an aqueous ink, imposes practical limits on the colorant weight percentage of approximately 8% colorant by weight, and more typically, approximately 3 to 6% by weight depending on the chemistry of the colorant, solvents and dispersion additives.

Experience in the printing industry over many decades has taught that inks having 20% to 30% by weight colorant must be deposited in films of wet thickness, $h_w$, approximately 1.5 to 3 μm to achieve adequate optical density. Similarly, experience with aqueous ink jet printing systems has taught that wet layer thicknesses of approximately 12 to 18 μm are needed to achieve optical densities of 1.0 OD or more. This experience in ink printing on paper media is consistent with the conclusion that a minimum of 0.4 to 0.6 μm of colorant thickness, $h_c$, is needed for high quality printing. A wet layer thickness approximately 6.7 μm is minimally required to have 0.4 μm of colorant thickness using an ink having 6 weight % colorant, and a 13.4 μm wet layer is needed for a 3 weight % colorant ink. If an 8 weight % ink could be reliably maintained, then a minimum wet layer thickness of 5 μm could be used for some paper types. For the purposes of the present inventions when applied to printing applications, a wet layer thickness, $h_w$, of 5 microns is the minimum contemplated.

The 5 μm wet layer thickness minimum discussed above is derived from experience with image printing on paper media. However, the present inventions are also contemplated to be used for the deposition of other functional materials in liquid form wherein the "active" component may not be a colorant and may not be needed as a 0.4 μm layer to perform the desired function. For example, the working fluid might carry a salt that results in a surface conductivity pattern, or a molecule that alters the hydrophobicity of a surface, and so on. For such non-printing liquid patterning, a wet layer thickness, $h_w$, of less than 5 μm is contemplated for non-printing applications.

Figure 10:
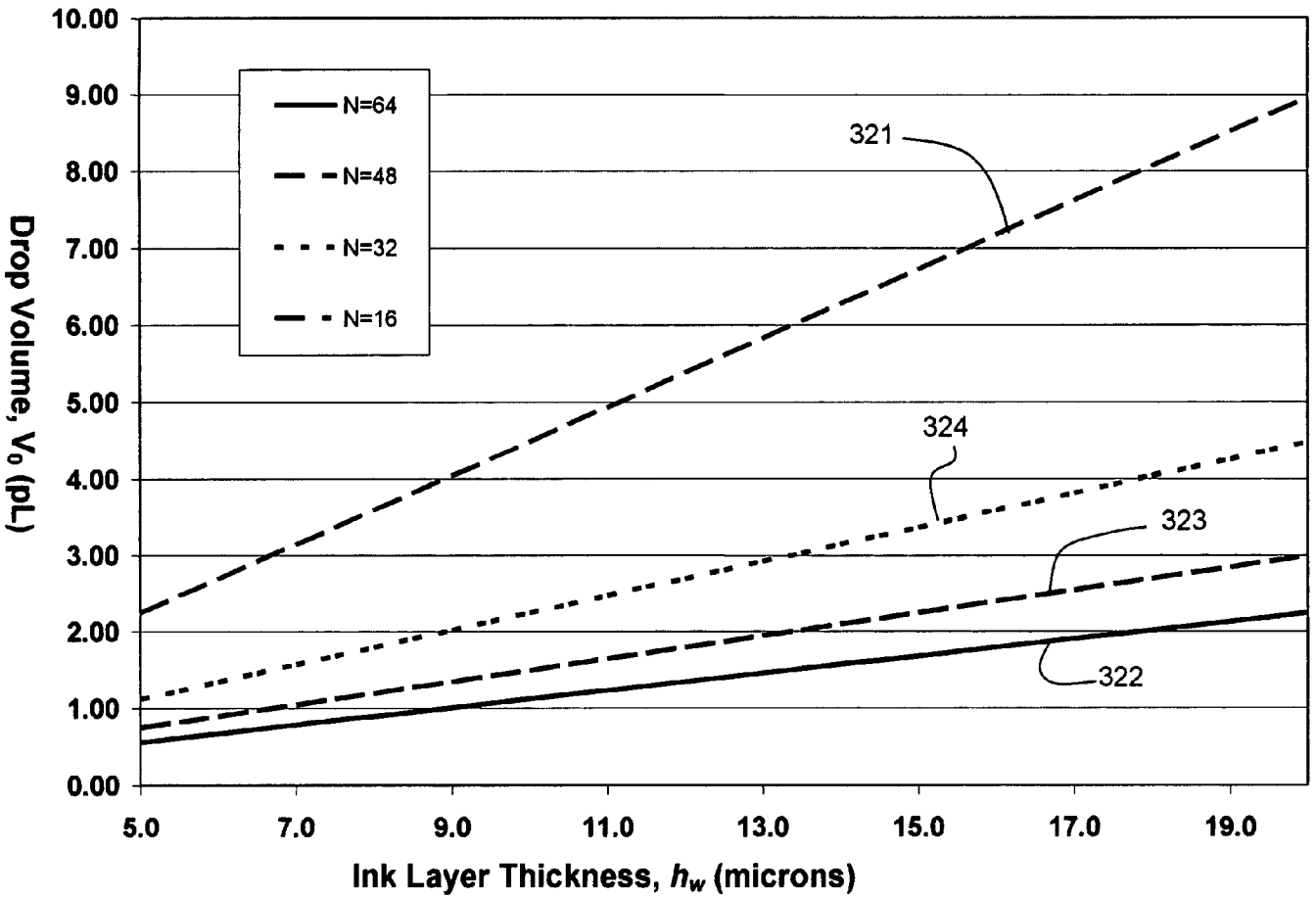
FIG. 10 provides plots of the unit drop volume required versus target liquid layer thickness for four different numbers of grey levels according to the present inventions.

In order to achieve the several system objectives for high quality liquid patterning laid out above, the unit drop volume, $V_0$, must be selected to be the proper size to achieve a target wet layer thickness, $h_w$, when up to N drops are applied within a single pixel area, $L_xL_y$. That is, $V_0$ must be sized so that the following relationship is satisfied:

$$V_0 = \frac{h_w L_x L_y}{N}, \tag{16}$$

where the maximum pattern cell liquid volume, $V_m$, laid down in any rectangular pattern cell is $V_m = h_w L_x L_y$. Unit drop volume, $V_0$, versus target wet layer thickness, $h_w$, is plotted according to Equation 16 in FIG. 10 for several cases wherein $L_x = L_y = 84.6$ μm, a pixel density of 300 dots per inch (dpi) in both directions. Values of $V_0$ vs. $h_w$ are plotted for N=16, 32, 48, and 64 which are labeled curves 321, 322, 323, and 324 respectively. The drop volume is given in units of picoLiters and the target wet layer thickness in microns. A convenient relationship between these units is 1 pL=$10^3$ μm. One picoliter of volume equals a cube with 10 micron sides.

It may be appreciated from FIG. 9 that unit drop volumes of less than 8 pL are needed to achieve pattern deposition of the minimum quality to be produced by the current inventions, characterized by $N \geqq 16$; $L_x$, $L_y < 85$ μm; and $h_w < 18$ μm. The plots in FIG. 10 for N=16, 32, 48, and 64 may also be viewed as illustrating the unit drop volume that would be required to achieve several minimum percentage dot sizes for 300 line screen printing, a common manner of expressing print quality capability in the graphics arts field. Metering the ink amount in a pixel area by 1/16 th is approximately equivalent to printing a 6% halftone dot. Metering the ink by 1/32 nd is approximately equivalent to printing a 3% halftone dot, and metering by 1/48 th produces a 2% halftone dot equivalent. Those skilled in the graphics arts will recognize that a system capable of printing 2% halftone dots for 300 line/inch screens produces state-of-the-art image quality. Preferred embodiments of the present inventions can achieve this very high level of image or pattern quality and at higher process speeds than have heretofore been possible.

The previous discussion has led to requirements for the unit drop volume necessary to produce very high quality images and patterns. Returning now to the drop emitter parameters previously discussed, the unit drop volume is determined by the effective nozzle diameter $D_0$ and the applied Rayleigh stimulation wave ratio, $L_0$:

$$V_0 = \frac{\pi}{4} L_0 D_0^3. \tag{17}$$

Recasting Equation 17 as an expression for the effective nozzle diameter in terms of the unit drop volume and wave ratio:

$$D_0 = \sqrt[3]{\frac{4V_0}{\pi L_0}}. \tag{18}$$

Figure 11:
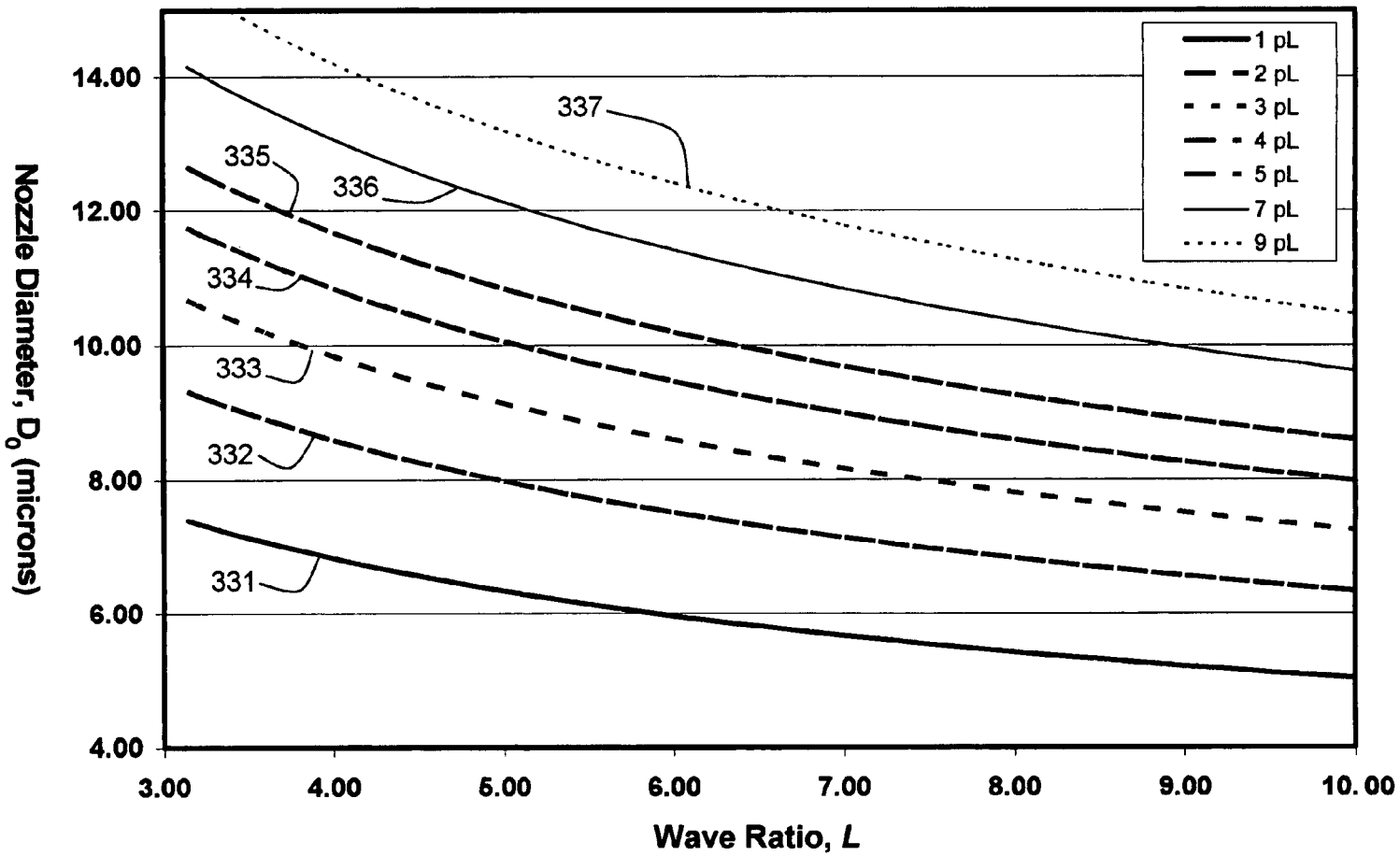
FIG. 11 provides plots of the effective nozzle diameter required for several unit drop volumes versus the thermal stimulation wave ratio applied according to the present inventions.

The effective nozzle diameter, $D_0$, required to produce drops of several unit volumes as a function of the wave ratio, L, is plotted in FIG. 11.

FIG. 11 shows the effective nozzle diameter, $D_0$, versus wave ratio, L, required to generate unit drop volumes of 1, 2, 3, 4, 5, 7 and 9 pL, labeled as plots 331, 332, 333, 334, 335, 336, and 337 respectively. The range of wave ratio plotted is π to 10. To specify a continuous drop emitter design one begins with the grey level or metering increment level desired, N, and the wet layer thickness needed, $h_w$, to arrive at a unit drop volume, $V_0$. Then, a nozzle diameter, $D_0$, and wave ratio, L are selected to achieve the desired unit drop volume. For example, if an N=48 level capability and wet liquid layer thickness $h_w$=15 μm are needed, then a drop volume of approximately 2.2 pL is required (see plot 323 in FIG. 10). Extrapolating just above the 2 pL curve 332 in FIG. 11, it may be seen that an effective nozzle diameter of approximately 6.5 to 8.5 μm would be required, depending on the choice of the wave ratio, which is further guided by a consideration of process speed, to be discussed below.

An N=16 capability at 300 dpi pixel density, the minimum quality level contemplated by the present inventions, would require a drop volume of approximately 7 pL for a wet liquid layer thickness $h_w$=15 μm. The effective nozzle diameter required would be in the range of 10 to 13 μm. Consequently, for the purpose of the present inventions, effective nozzle diameters must be less than approximately 13 μm.

The nozzle diameter choice is bounded on the lower end by practical fabrication considerations. Modern photofabrication techniques have pushed the resolution of features that may be fabricated to very small values in the fabrication of microelectronic devices. State-of-the art photofabrication techniques are needed to achieve large arrays of nozzles having sufficient uniformity of shape and effective flow area when the nominal nozzle size must be in the range conveyed by FIG. 11. If the effective nozzle diameter varies by some amount over an ensemble of hundreds or thousands of jets in a drop emitter array, the drop volumes produced and the surface wave growth factors that lead to break-up, will vary accordingly, producing low quality patterns and images.

Figure 12:
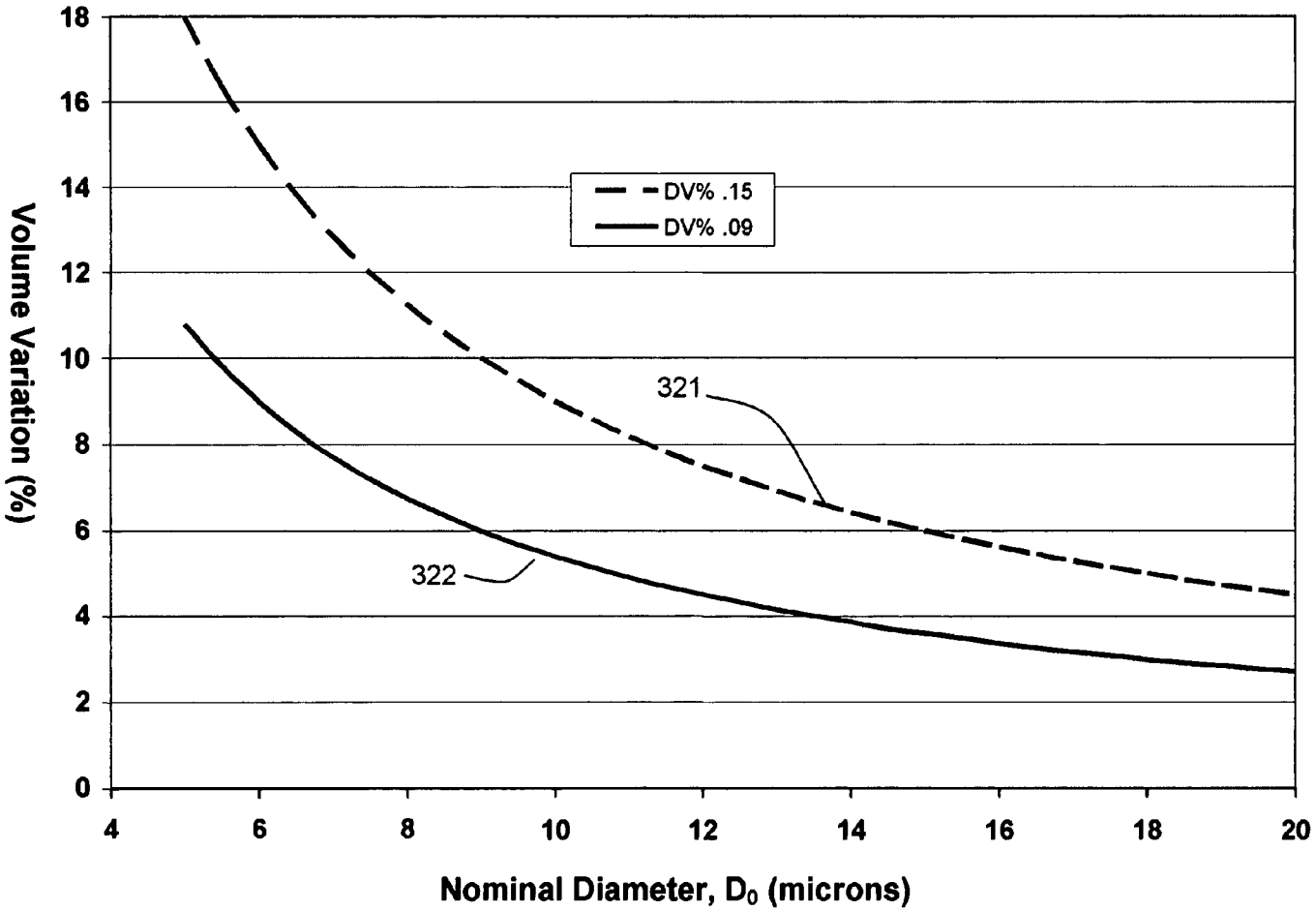
FIG. 12 provides plots of an estimate of the percentage volume variation in the unit drop volume versus effective nozzle diameter for two fabrication spatial design rule values.

FIG. 12 illustrates the variation in drop volume that would result if two different levels of photofabrication design rules were utilized: 0.15 μm and 0.09 μm. By "design rule" in this context it is meant the tolerance to which a dimension may be produced with reasonable yield and reproducibility. Use of design rules in the 0.09 μm to 0.15 μm range are at the leading edge of the state of the art and may not be feasible for forming nozzle array devices that must extend over page dimensions of 8.5 inches or longer. Plots 321 and 322 in FIG. 11 illustrate the percentage volume change produced by a variation of ±0.15 μm or ±0.09 μm in effective nozzle diameter, respectively, on the drop volume generated for a wave ratio, L=4.5. The percentage volume variation is plotted versus the nominal volume. The amount of drop volume variation that may be tolerated depends somewhat on the application being served by the liquid drop patterning system.

For the case of high quality printing it is generally accepted that a variation of drop volume within an image or between images of less than 10% is needed to achieve consistent color hue and to avoid visible banding in mid-tone image areas. Thus, from FIG. 12 it may be appreciated that effective nozzle diameters of less than approximately 6 μm are not practical for creating very high quality liquid pattern deposition drop emitter arrays.

Variation in the effective nozzle diameter, $D_0$, will also affect the growth rate of the applied Rayleigh synchronization surface waves as may be appreciated from the dependence of γ on $D_0$ and wave ratio that is captured in above Equation 2. As for the volume variation estimated in FIG. 12, it is assumed that an array of jets is photofabricated to have nominally all the same effective nozzle diameters $D_0$, except with some variation Δ equal to the design rule, i.e. Δ=0.15 μm or 0.09 μm in this analysis. Equations 2 and 5 above are evaluated for the case of nozzles that are Δ larger or smaller than the nominal size resulting in an expression for the surface wave growth for the larger and smaller nozzles, designated $\delta^+$ and $\delta^-$, respectively. To understand the consequences of the variation in growth rate arising from the nozzle diameter variation, the ratio $\delta^-/\delta^+$ is evaluated at a representative time, t:

$$\gamma^{+2} = \frac{4\sigma}{\rho(D_0+\Delta)^3}\frac{\pi^2}{L^{+2}}\left(1-\frac{\pi^2}{L^{+2}}\right), \tag{19}$$

$$\gamma^{-2} = \frac{4\sigma}{\rho(D_0-\Delta)^3}\frac{\pi^2}{L^{-2}}\left(1-\frac{\pi^2}{L^{-2}}\right), \tag{20}$$

$$\bar{\delta}^-(0,t)/\bar{\delta}^+(0,t) = e^{(\gamma^- - \gamma^+)t} \tag{21}$$

where $L^{\pm}=v_{j0}/f_0(D_0\pm\Delta)$. Equations 19-21 are evaluated at t=20 μsec for Δ=0.15 μm and 0.09 μm and plotted as curves 338 and 339, respectively, in FIG. 13. The growth factor dependence on Δ, via L, is third order in (Δ/D) and so was ignored in calculating the curves in FIG. 13.

Figure 13:
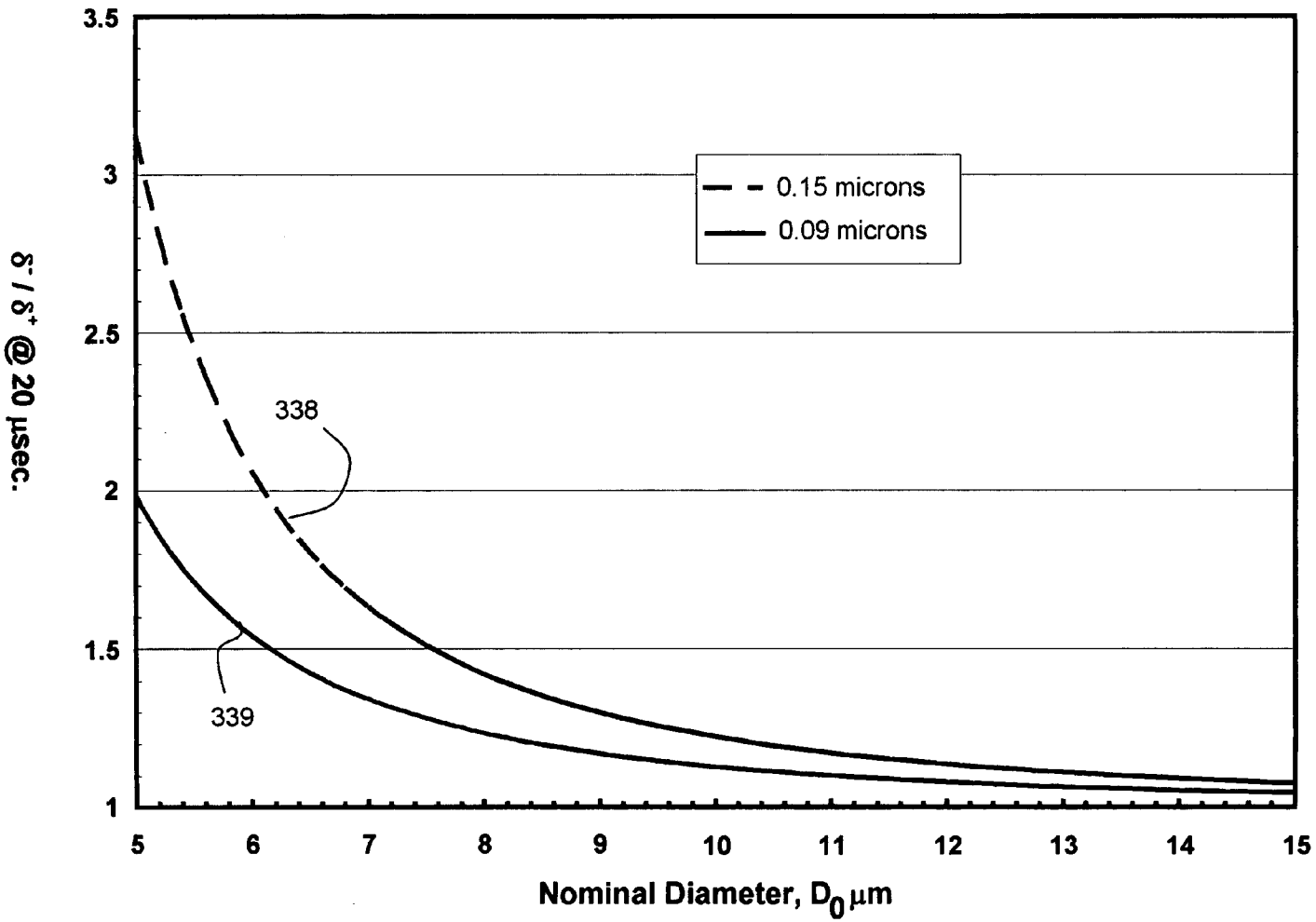
FIG. 13 provides plots of an estimate of the variation in stimulated surface wave amplitude after 20 μseconds versus effective nozzle diameter for two fabrication spatial design rule values.

Plots 338 and 339 in FIG. 13 show that small variations in effective nozzle diameter can lead to large differences in the break-up lengths of the jets in an array. The variation becomes pronounced as the nominal nozzle diameter, $D_0$, is reduced. For nozzles fabricate using a 0.15 μm design rule capability, the spread in surface wave amplitude at 20 μsecs reaches a factor of 2 at $D_0$=6 μm. If the design rule capability is 0.09 μm, the spread is a factor of 2 at $D_0$=5 μm. These differences in surface wave growth translate into different break-off lengths for different jets in an array, and ultimately, differences in the ability to properly select and time the arrival of drops from different jets at the print plane.

In addition to variations in the nozzle diameter, variations in stimulation pulse heat transfer, due to variations in the spacing, widths and lengths of heaters, will cause similar variations in jet-to-jet break-off behavior. If the growth factors were similarly evaluated for the heater fabrication tolerance variations expressed in Equations 12 and 13, similar consequences of the effects of MEMS process design rule limitations would be seen for break-off times and lengths.

In addition to the considerations discussed above regarding effective nozzle diameter and wave ratio, a set of trade-off decisions is also necessary with respect to the process speed, S, of the liquid pattern deposition and the velocity of the jetted fluid, $v_{jo}$. The process speed, S, is determined by the requirements of the application. For example, the present inventions contemplate a liquid deposition system capable of printing color images on various media stock at the rate of 1 meter/sec and higher. An individual nozzle must be able to supply at least N drops, the grey level or pattern metering increment level, within a pattern cell length in the process direction, $L_x$. That is, the Rayleigh stimulation frequency, $f_0$, must be at least high enough to cause jet break-up into enough drops per time to satisfy simultaneously the application requirements for throughput, S, and pattern quality, N levels per pixel. Since the physics of stimulated stream break-up links jet velocity, wave ratio and frequency together, constraints are imposed on the choices of the operating wave ratio $L_0$, nozzle diameter $D_0$, and jet velocity, $v_{j0}$, for a given set of application parameters: N, $L_x$, $h_w$ and S.

To further understand the design tradeoffs among the several applications and jet physics variables it is useful to examine the jet velocity and wave ratio choices that are possible for different combinations of the application parameters. The jet velocity may be expressed as a function of the application parameters in the following manner:

$$f_0 \geq N\frac{S}{L_x}, \tag{22}$$

$$D_0 = \sqrt[3]{\frac{4}{\pi}\frac{h_w L_x L_y}{N L_0}}, \tag{23}$$

$$v_{j0} = f_0\lambda_0 \geq \left[N\frac{S}{L_x}\right]\left[L_0\sqrt[3]{\frac{4}{\pi}\frac{h_w L_x L_y}{N L_0}}\right], \tag{24}$$

$$v_{j0} \geq S\sqrt[3]{\frac{4}{\pi}\frac{h_w L_y}{L_x^2}N^2 L_0^2}, \tag{25}$$

where all of the parameters in Equations 22-25 have been previously defined. The jet velocity must be higher than the quantity on the right hand side of Equation 25 in order that the stream may be broken up into enough drops of the needed volume in the needed amount of time. Equation 25 combines the application factors of pattern layer quality ($h_w$, $L_x$, $L_y$, N) and process speed (S) with the constraints of the physics of stream break-up ($L_0$). The minimum jet velocity required is found when the velocity equals the right hand side of Equation 25.

For some applications, more drops, M, may be generated than are required to satisfy the pattern lay down requirements, N, denoted by the right hand side of Equation 22. The extra, "non-printing" drops may be used as "guard drops" to alter aerodynamic and electrostatic interactions during droplet flight, or to allow the timing of drop deposition to be adjusted by shifting the pattern data in time along a given jet stream. Each jet must therefore form an integer number (M+N) drops during a unit pattern cell length time, $t_x=L_x/S$, therefore $(M+N)\tau_0=L_x/S$. For such drop emission system designs, the jet velocity must be increased accordingly to supply enough liquid for the "non-printing" drops and allow operation at a frequency of $f_0=1/\tau_0=S\ L_x(M+N)$.

The minimum operating jet velocity, $v_{jo}$, according to Equation 25, is plotted versus wave ratio for a variety of configurations of the application parameters in FIGS. 14 through 21. The selection of jet velocity according to the present inventions will be explained hereinbelow with reference to the many plots of FIGS. 14 through 21. It may be appreciated from Equation 25 that the required jet velocity is directly proportional to the required process speed, S, and nearly proportional (by the $2/3^{rds}$ power) to the required number of grey levels per pixel. Doubling the process speed requirement, and/or the grey level requirement, will double or quadruple the jet velocity requirement. Therefore, the implementation of high speed, high quality drop deposition systems necessarily pushes the required jet velocity to practical limits.

The practical limits on jet velocity are not definitive. In general, for fluids having surface tension and viscosity in the ranges discussed above, and deposited in target layer thicknesses of 5 μm to 20 μm, the jet velocity should be constrained to be less than 25 m/sec and more preferably, to 20 m/sec or less. If larger jet velocities are attempted, liquid spatter and mist seriously degrade both pattern quality and the reliability of the drop emission hardware. For the multiple drop per pixel patterns (N>2) that are essential to the present inventions, drops will impact previously deposited drops on the receiver surface within a few microseconds of each other, potentially causing small droplets of fluid to rebound from the surface. Tiny rebounding ink drops become airborne mist or resettle as errant liquid landing outside intended pixel patterns. The production of mist and spatter is controlled, in part, by the kinetic energy of the incoming drops and the mechanisms for dissipating this energy. Limiting the kinetic energy by limiting the jet velocity is the most direct approach to controlling mist and spatter. Therefore the present inventions are configured within the constraint that the jet velocity is not allowed to exceed 20 m/sec.

The practical limits on operating wave ratio, $L_0$, are also not definitive. However, operation with $L_0<4$ is considered impractical for the present inventions because of the rapid change in the growth factor in the regime $\pi<L_0<4$ as illustrated by plot 302 in FIG. 2. The growth factor is dependent on surface tension which varies with temperature and ink formulation changes. In addition the jet diameter, herein equated with the effective nozzle diameter, actually also varies with temperature via viscosity effects which were ignored in the previous analysis. Therefore, to avoid excessive time and temperature dependent variation in drop break-off lengths, the present inventions are operated using stimulation frequencies, $f_0$, so that $L_0>4$.

Figure 14:
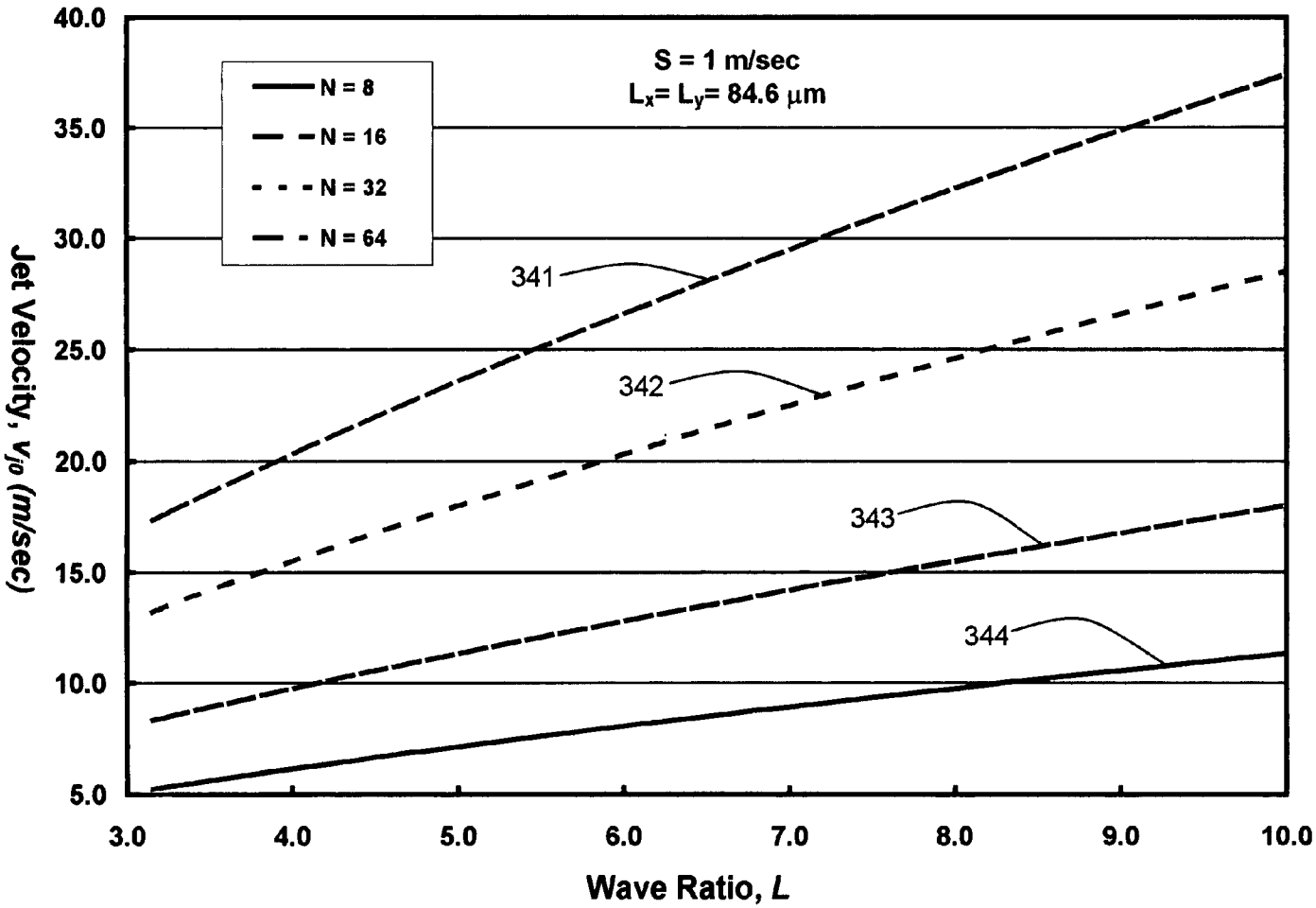
FIG. 14 provides plots of the jet velocity and wave ratio required to form a liquid pattern at 1 meter per second process speed and 15 microns target layer thickness, using drops of the needed unit volume for several numbers of grey levels and a drop emitter array having an effective nozzle spacing of 84.6 microns.

FIG. 14 provides plots of the jet velocity versus wave ratio required to form a liquid pattern at S=1 meter per second, $h_w$=15 microns target layer thickness, and $L_x=L_y$=84.6 microns. Curves 341, 342, 343, and 344 plot the relationship for N=64, 32, 16, and 8 respectively.

Figure 15:
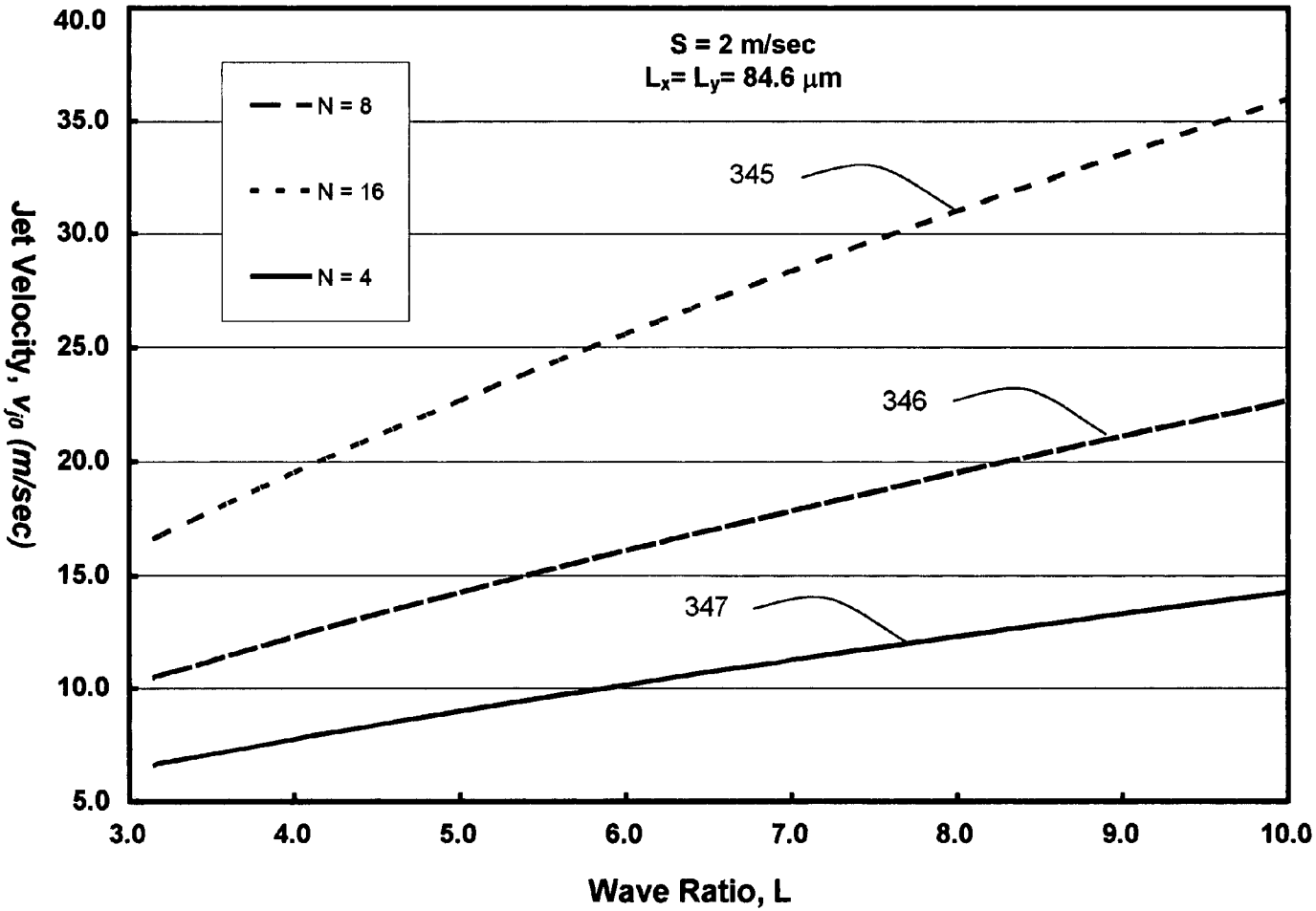
FIG. 15 provides plots of the jet velocity and wave ratio required to form a liquid pattern at 2 meters per second process speed and 15 microns target layer thickness, using drops of the needed unit volume for several numbers of grey levels and a drop emitter array having an effective nozzle spacing of 84.6 microns.

FIG. 15 provides plots of the jet velocity versus wave ratio required to form a liquid pattern at S=2 meter per second, $h_w$=15 microns target layer thickness, and $L_x=L_y$=84.6 microns. Curves 345, 346, and 347 plot the relationship for N=16, 8 and 4 respectively.

Figure 16:
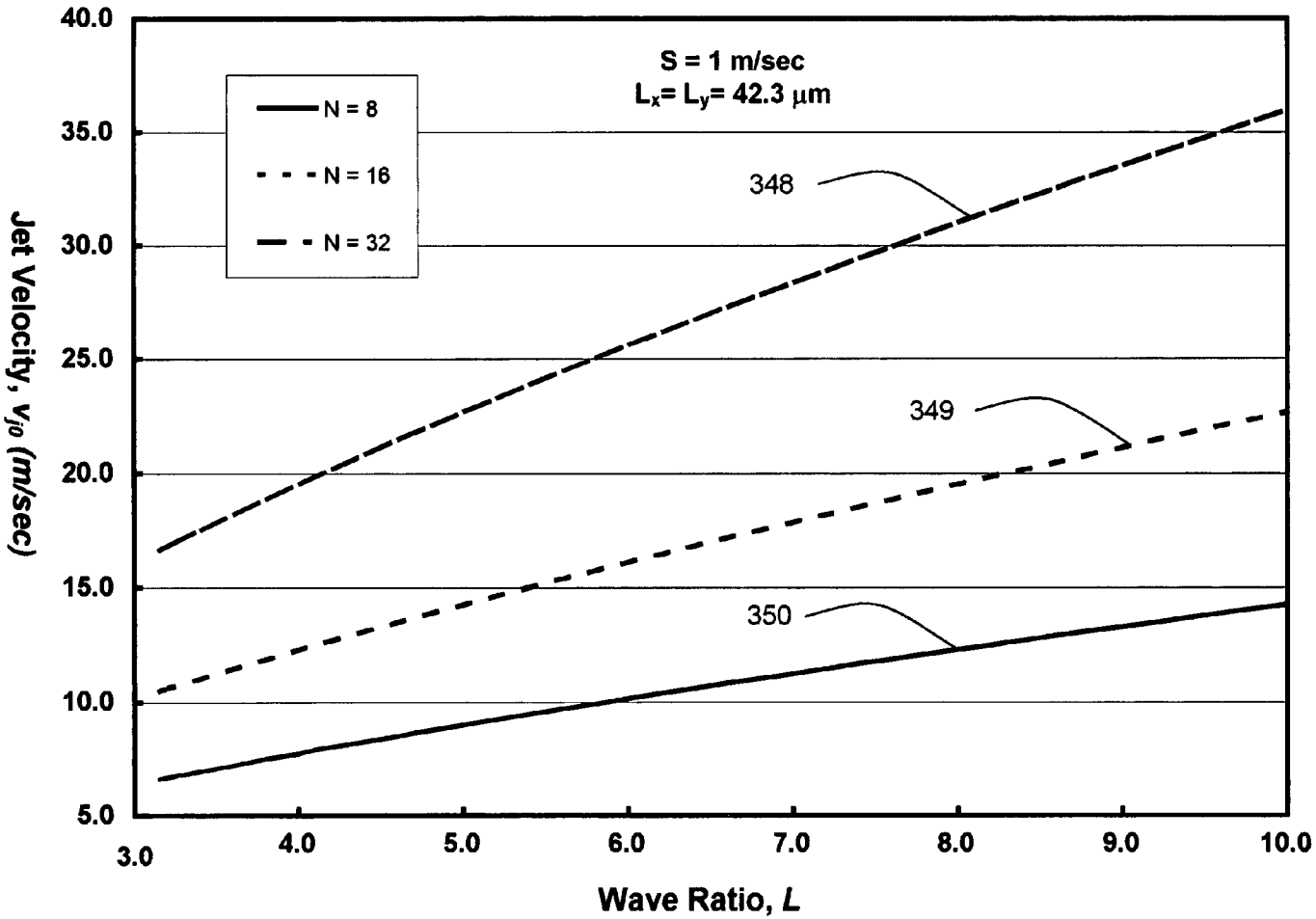
FIG. 16 provides plots of the jet velocity and wave ratio required to form a liquid pattern at 1 meter per second process speed and 15 microns target layer thickness, using drops of the needed unit volume for several numbers of grey levels and a drop emitter array having an effective nozzle spacing of 42.3 microns.

FIG. 16 provides plots of the jet velocity versus wave ratio required to form a liquid pattern at S=1 meter per second, $h_w$=15 microns target layer thickness, and $L_x=L_y$=42.3 microns. Curves 348, 349, and 350 plot the relationship for N=32, 16 and 8 respectively.

Figure 17:
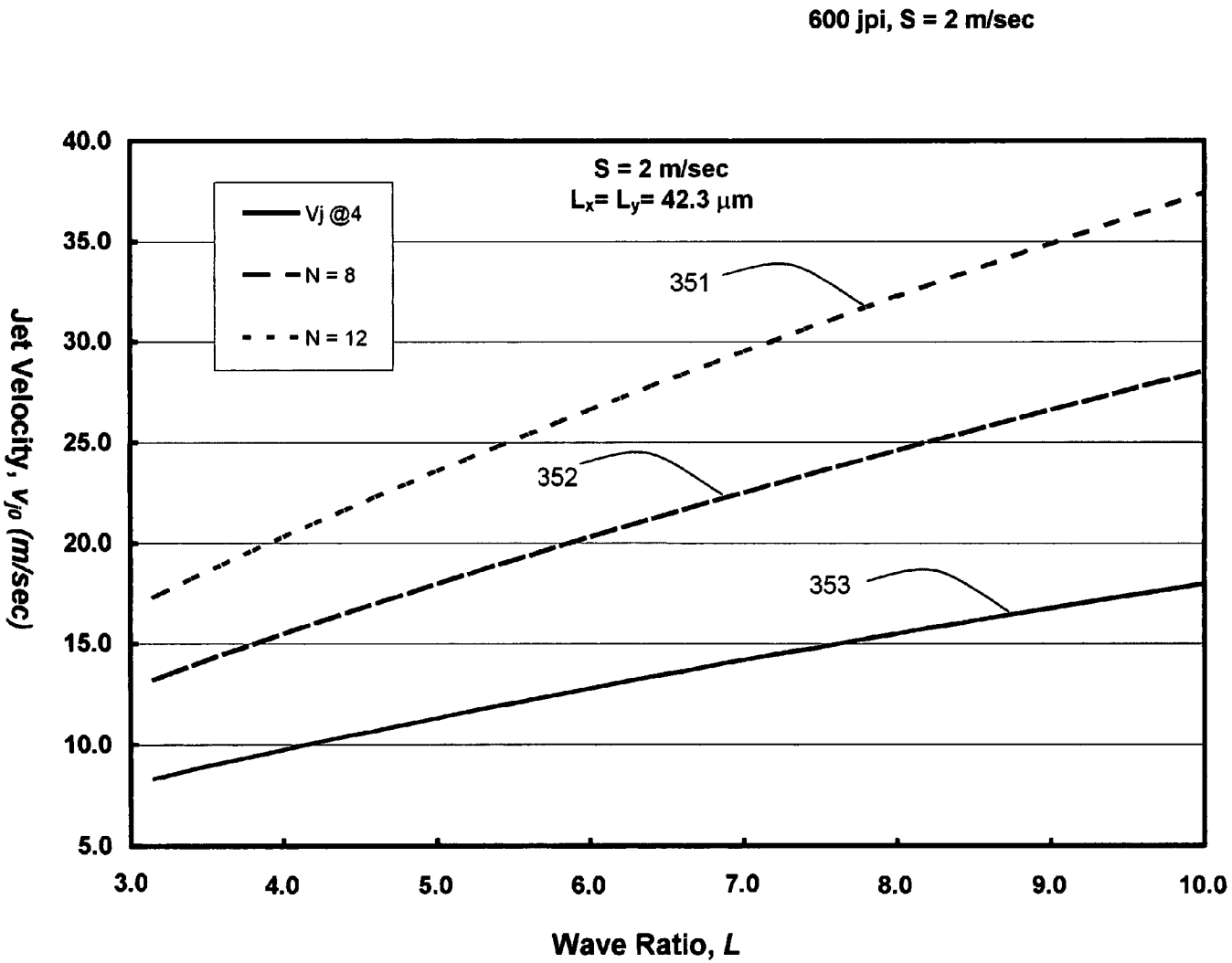
FIG. 17 provides plots of the jet velocity and wave ratio required to form a liquid pattern at 2 meters per second process speed and 15 microns target layer thickness, using drops of the needed unit volume for several numbers of grey levels and a drop emitter array having an effective nozzle spacing of 42.3 microns.

FIG. 17 provides plots of the jet velocity versus wave ratio required to form a liquid pattern at S=2 meter per second, $h_w$=15 microns target layer thickness, and $L_x=L_y$=42.3 microns. Curves 351, 352, and 353 plot the relationship for N=12, 8 and 4 respectively.

Figure 18:
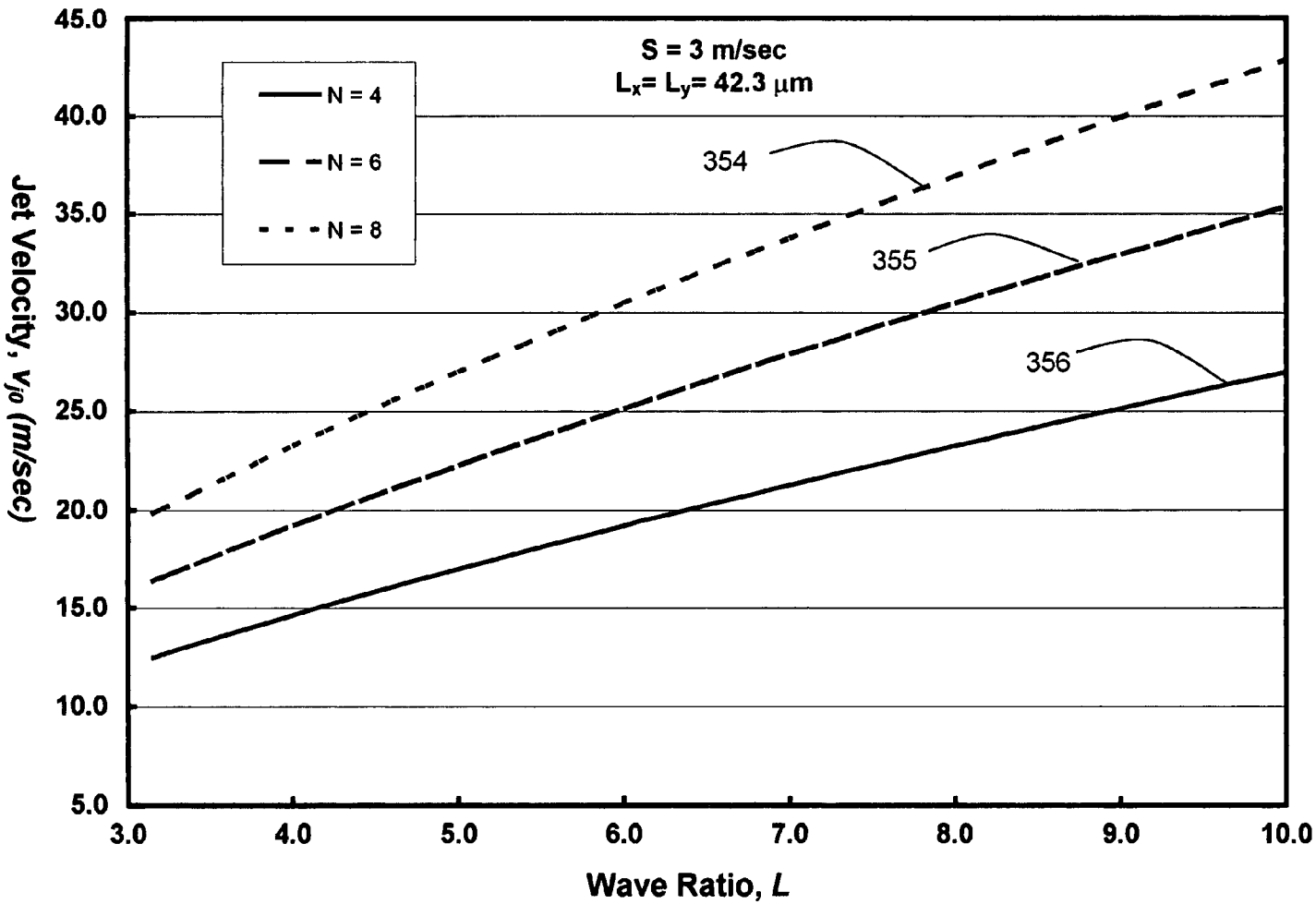
FIG. 18 provides plots of the jet velocity and wave ratio required to form a liquid pattern at 3 meters per second process speed and 15 microns target layer thickness, using drops of the needed unit volume for several numbers of grey levels and a drop emitter array having an effective nozzle spacing of 42.3 microns.

FIG. 18 provides plots of the jet velocity versus wave ratio required to form a liquid pattern at S=3 meter per second, $h_w$=15 microns target layer thickness, and $L_x=L_y$=42.3 microns. Curves 354, 355, and 356 plot the relationship for N=8, 6 and 4 respectively.

Figure 19:
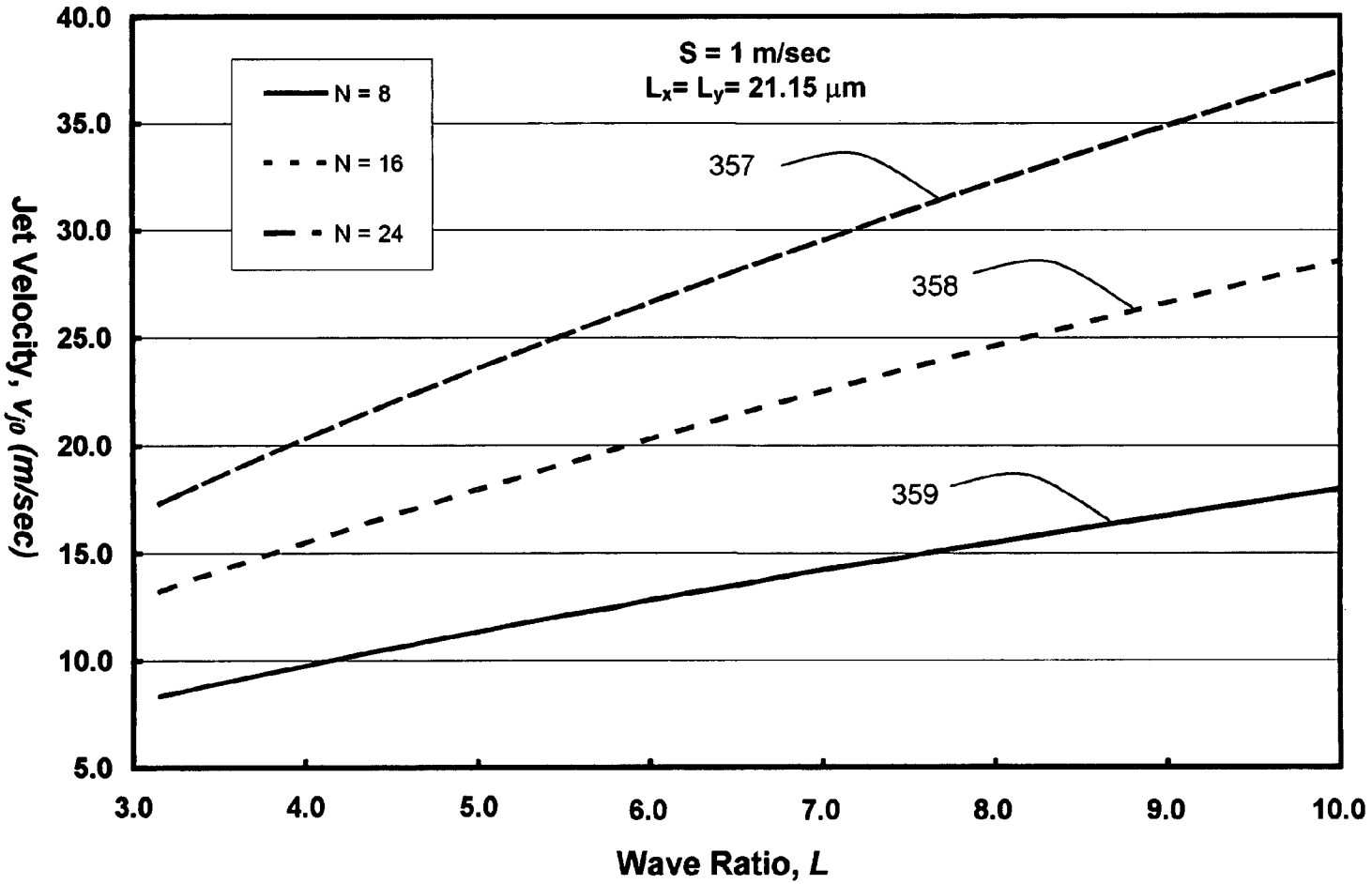
FIG. 19 provides plots of the jet velocity and wave ratio required to form a liquid pattern at 1 meter per second process speed and 15 microns target layer thickness, using drops of the needed unit volume for several numbers of grey levels and a drop emitter array having an effective nozzle spacing of 21.15 microns.

FIG. 19 provides plots of the jet velocity versus wave ratio required to form a liquid pattern at S=1 meter per second, $h_w$=15 microns target layer thickness, and $L_x=L_y$=21.15 microns. Curves 357, 358, and 359 plot the relationship for N=24, 16 and 8 respectively.

Figure 20:
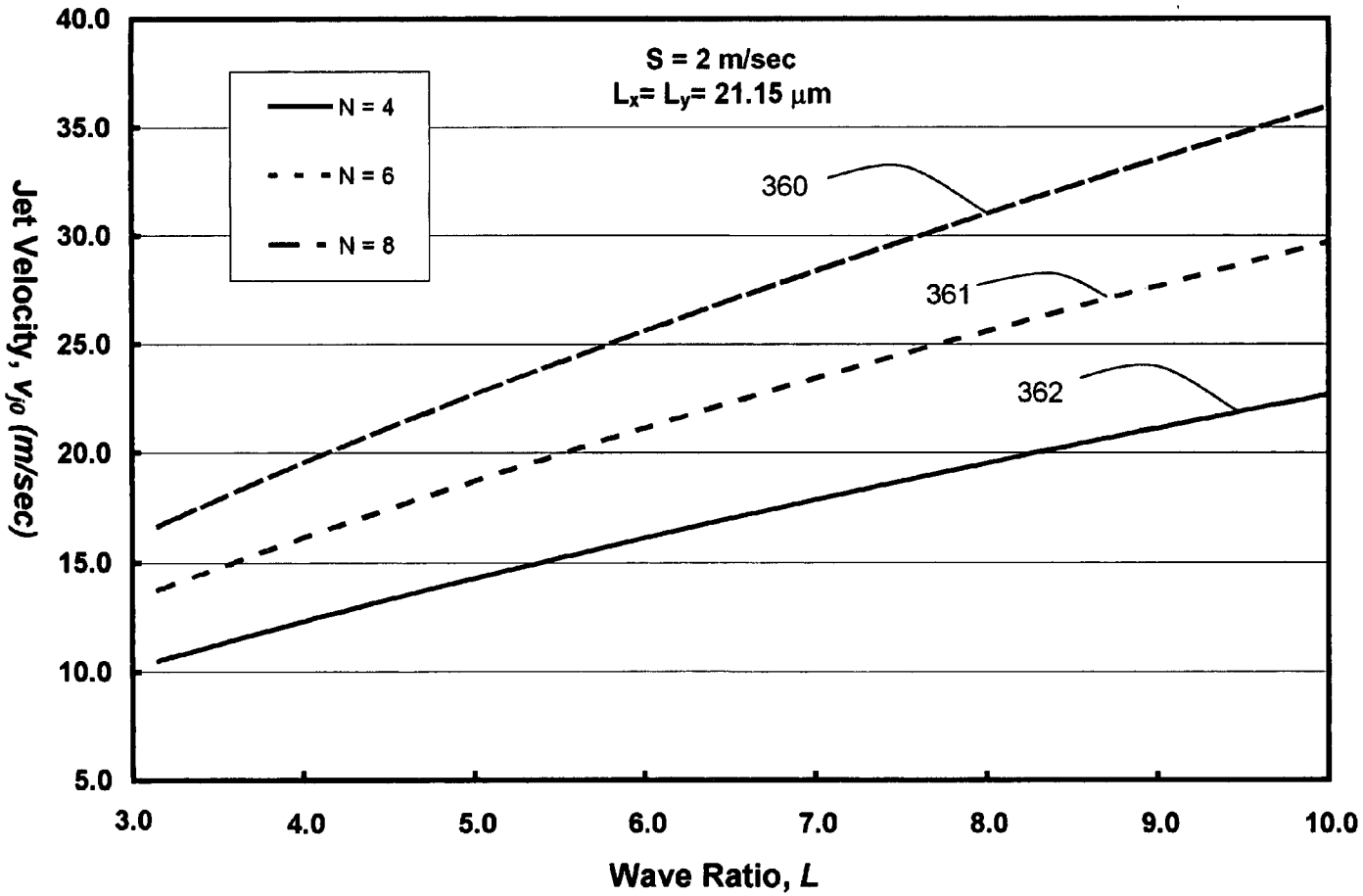
FIG. 20 provides plots of the jet velocity and wave ratio required to form a liquid pattern at 2 meters per second process speed and 15 microns target layer thickness, using drops of the needed unit volume for several numbers of grey levels and a drop emitter array having an effective nozzle spacing of 21.15 microns.

FIG. 20 provides plots of the jet velocity versus wave ratio required to form a liquid pattern at S=2 meter per second, $h_w$=15 microns target layer thickness, and $L_x=L_y$=21.15 microns. Curves 360, 361, and 362 plot the relationship for N=8, 6 and 4 respectively.

Figure 21:
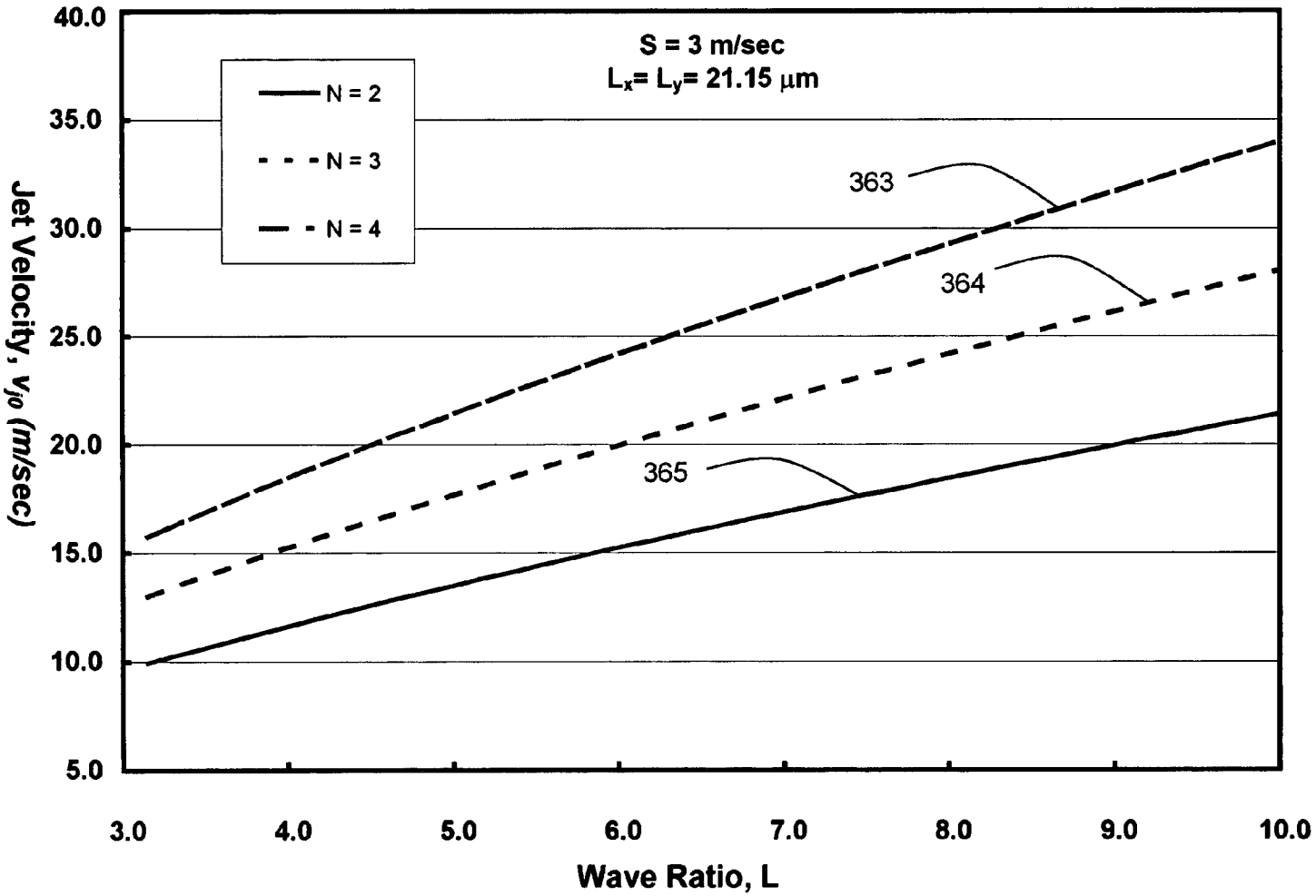
FIG. 21 provides plots of the jet velocity and wave ratio required to form a liquid pattern at 3 meters per second process speed and 15 microns target layer thickness, using drops of the needed unit volume for several numbers of grey levels and a drop emitter array having an effective nozzle spacing of 21.15 microns.

FIG. 21 provides plots of the jet velocity versus wave ratio required to form a liquid pattern at S=3 meter per second, $h_w$=15 microns target layer thickness, and $L_x=L_y$=21.15 microns. Curves 363, 364, and 365 plot the relationship for N=4, 3 and 2 respectively.

FIGS. 14 thru 21 illustrate the limitations on process speed, S, and grey level capability N, which arise from limiting the jet velocity to 20 m/sec or less. For example, curve 341 plotted in FIG. 14, shows that a 300 pixel cell per inch system having N=64 capability is impractical for a process speed S=1 m/sec. Plot 341 indicates that operation at L<4 would still be possible, however as was stated previously, it is difficult to control an ensemble of jets at wave ratios less than 4 because the growth factor changes rapidly with respect to surface tension and jet diameter between L=π and 4, wherein both factors are temperature and working liquid formulation dependent.

At pixel cell density 300 dpi, if the process speed is doubled to 2 m/sec, then even an N=16 capability is impractical, as indicated by plot 345 in FIG. 15. Thus, if a liquid pattern deposition system is required to achieve at least 3% dot at 300 cells/inch quality, then it must be operated a 1 m/sec or less if the effective nozzle spacing is 300/per inch, ($L_y$=84.6 μm). Plots in FIGS. 14 and 15 indicate that the limits imposed by a 20 m/sec jet velocity maximum mean that more jets per inch are needed to achieve higher pattern quality at higher process speeds. Simple put, more drops per time are needed and the physics of continuous stream break-up are making higher drop generation frequencies impractical.

FIGS. 16, 17, and 18 plot required jet velocity for a configuration having jets at an effective array density of 600 jets/inch, $L_y$=42.6 μm, and 600 pixels/inch in the process direction, $L_y$=42.6 μm. At 600 pattern cells/inch, an image or functional material pattern having N=16 is at least equivalent in quality to a 64 drops/cell pattern at 300 pattern cells/inch. Similarly, with 600 pattern cells/inch, an N=12 system can provide pattern quality equivalent to reproducing 2% dots at 300 halftone cells/inch (cpi). It may be understood from FIGS. 16 through 18 that the 2% dot @ 300 cpi level of quality may be provided at 1 m/sec process speed, however not at 2 m/sec process speed or above. At 3 m/sec process speed, a 600 jet/inch drop emitter configuration can achieve N=4, equivalent to 6.7% dots @ 300 cpi.

FIGS. 19, 20, and 21 plot required jet velocity for a configuration having jets at an effective array density of 1200 jets/inch, $L_y$=21.15 μm, and 600 pixels/inch in the process direction, $L_y$=21.15 μm. At 1200 pattern cells/inch, an image or functional material pattern having N=4 is at least equivalent in quality to a 64 drops/cell pattern at 300 pattern cells/inch. Similarly, with 1200 pattern cells/inch, an N=3 system can provide pattern quality equivalent to reproducing 2% dots at 300 halftone cells/inch. It may be understood from FIGS. 19 through 21 that the 2% dot @ 300 cpi level of quality may be provided even at 3 m/sec process speed.

FIGS. 22, 23, 24 and 25 are illustrations of the laying down of multiple drops for pattern cells of density 300 cpi, 300 cpi, 600 cpi and 1200 cpi respectively. For the 300 cpi pattern illustrated in FIG. 22, 8 drops 156 have been deposited in the process direction P out of 16 possible drop positions 152. An alternate way of describing this N=16 capability is to define the addressability in the process direction, $A_p$:

$$A_p = L_x/N \tag{26}$$

Figure 22:
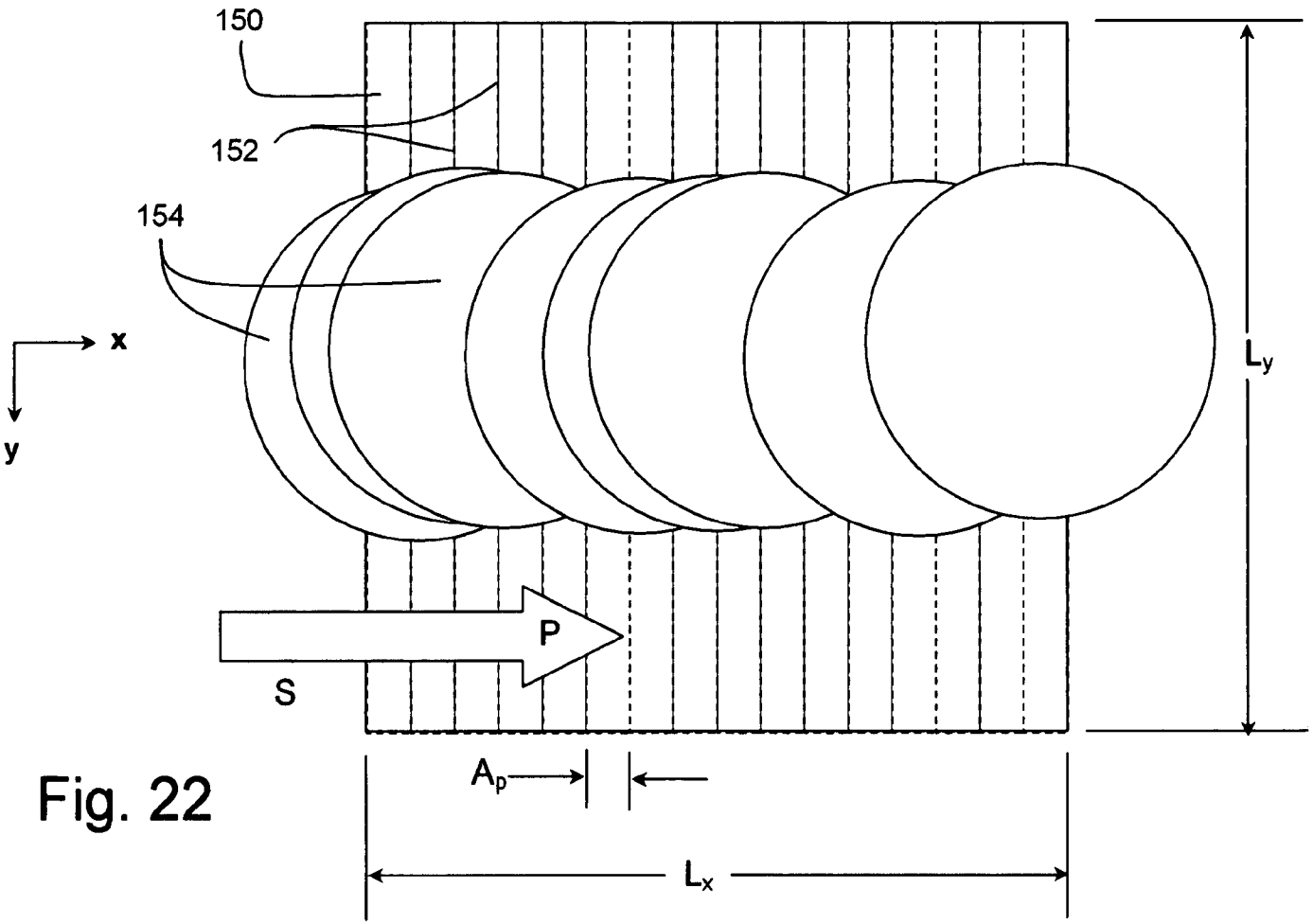
FIG. 22 illustrates the deposition of 8 of a possible 16 drops in a single pattern cell according to the present inventions.
Figure 23:
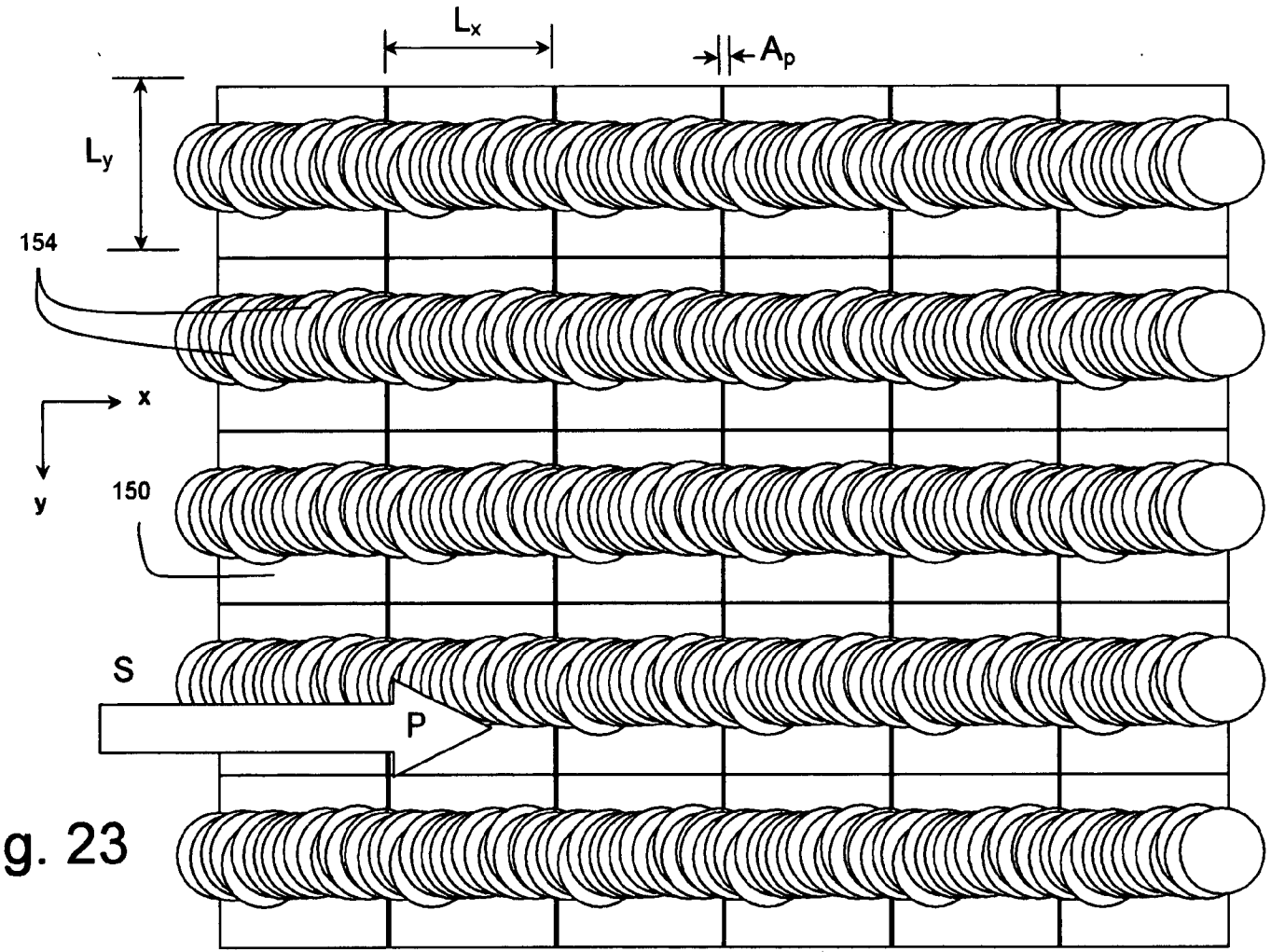
FIG. 23 illustrates the deposition of 16 drops in each of a matrix of 84.6 micron pattern cells forming a layer of liquid of the target thickness according to the present inventions.

In FIG. 22, $A_p$=84.6 μm/16=5.3 μm. FIG. 23 illustrates the lay down of 16 drops per cell for a 300 cpi configuration, drawn at a much smaller scale than FIG. 23. FIG. 23 illustrates how a full layer thickness area might appear if the liquid drops did not immediately spread over the surface. The low viscosity, high surface tension liquids of the present inventions are expected to spread out to form a uniform layer of thickness $h_w$.

Figure 24:
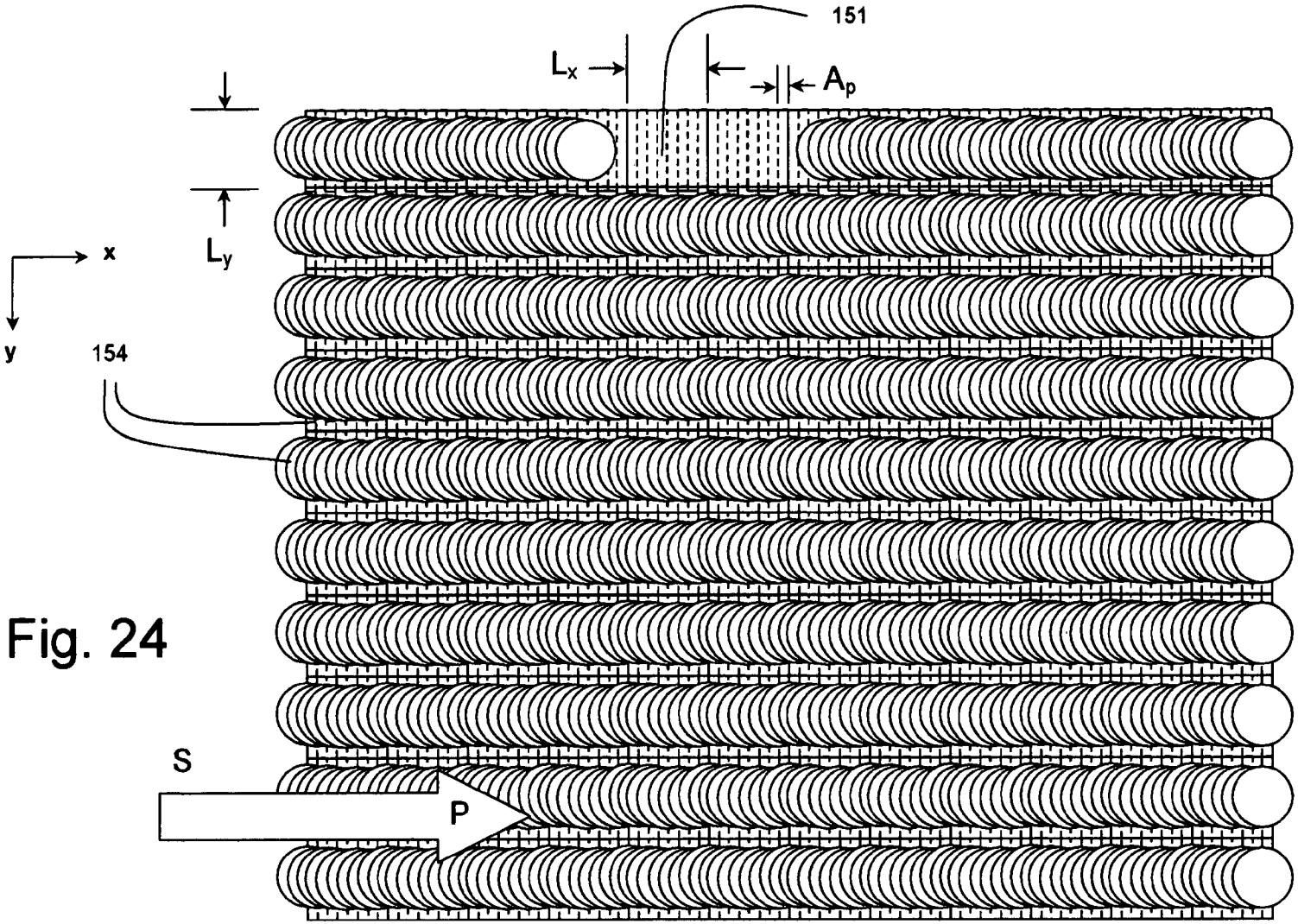
FIG. 24 illustrates the deposition of 8 drops in each of a matrix of 42.3 micron pattern cells forming a layer of liquid of the target thickness according to the present inventions.
Figure 25:
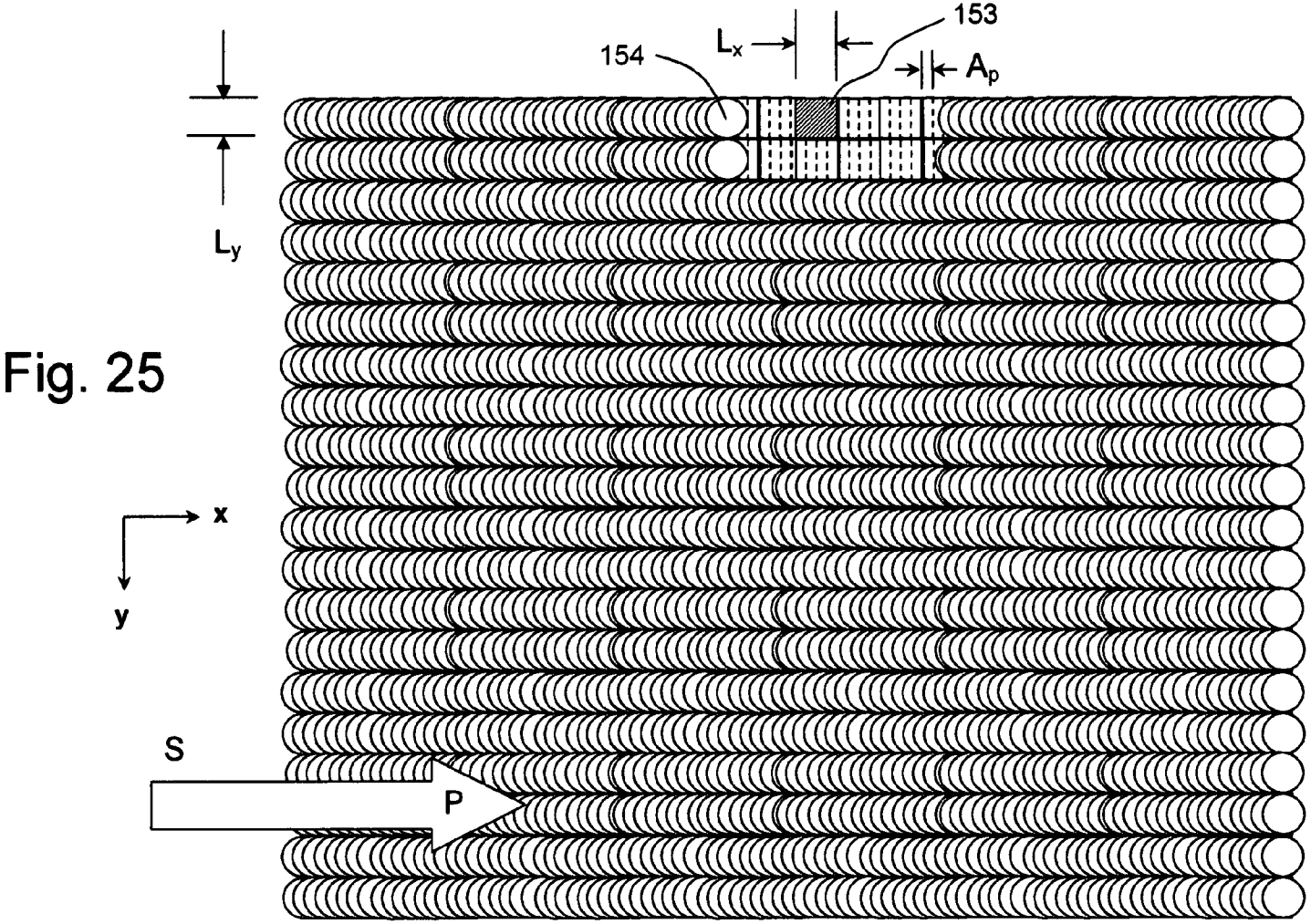
FIG. 25 illustrates the deposition of 4 drops in each of a matrix of 21.15 micron pattern cells forming a layer of liquid of the target thickness according to the present inventions.

FIGS. 24 and 25 illustrate lay down of a same overall thickness of liquid layer as in FIG. 23, except deposited as 8 drops per cell at 600 cpi (FIG. 24) or 4 drops per cell at 1200 cpi (FIG. 25). FIGS. 23, 24 and 25 are drawn to approximately the same scale and convey the improved uniformity of deposition that results from increasing the number of jets/inch. The addressability of all three configurations in the process direction is the same, $A_p$=5.3 μm. However the improved addressability in the jet array direction, $L_y$, is very beneficial for improved layer deposition uniformity, in addition to the greatly enhanced process speed capability previously noted. This improved addressability, consistent with operation of a very high speed, high quality CIJ apparatus for the deposition of materials, has not been previously recognized because the system operation has not been previously considered in view of the design rules for nozzle architecture.

Figure 26:
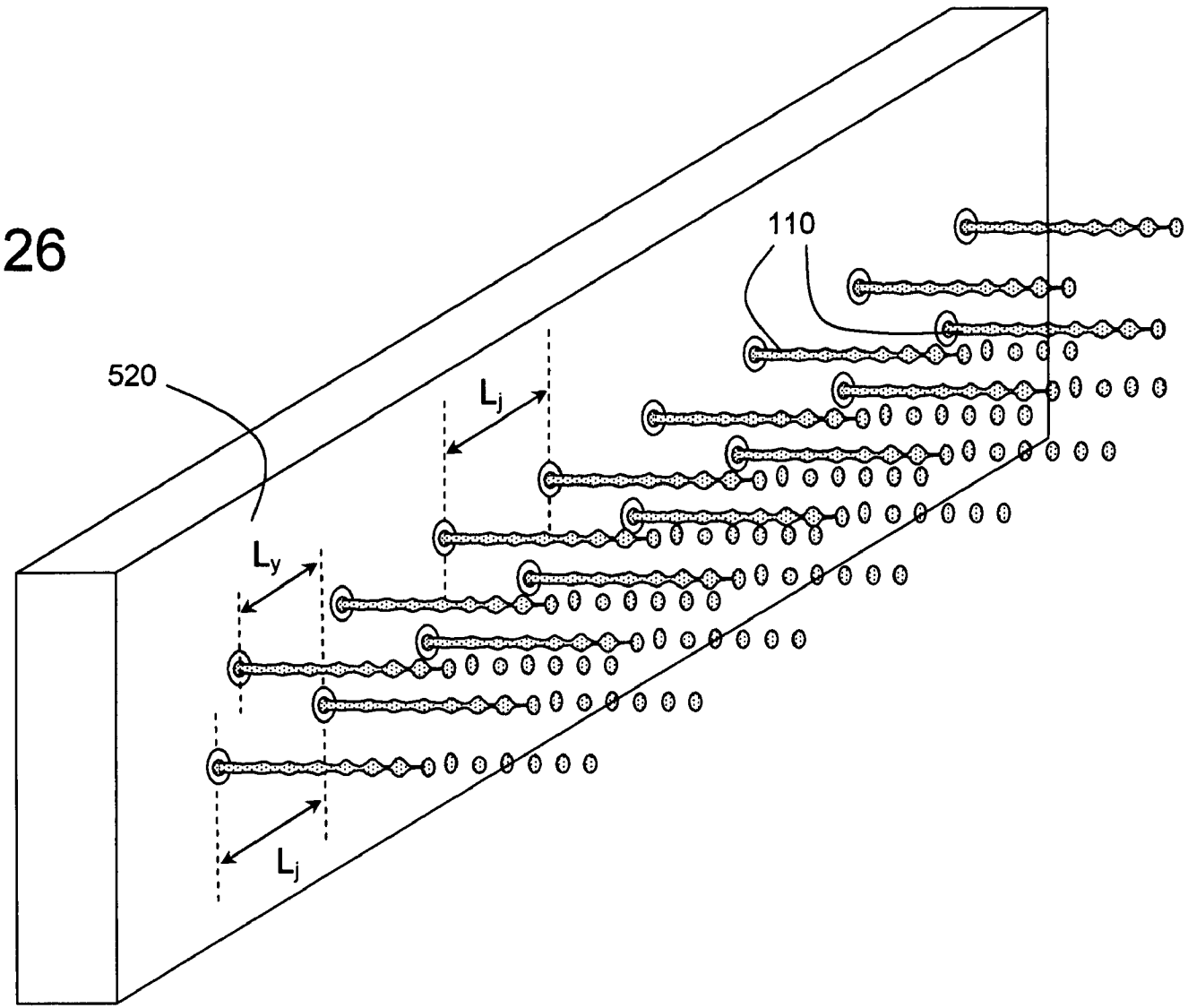
FIG. 26 illustrates a jet array formed of two interdigitated rows of nozzles according to the present inventions.

FIG. 26 illustrates an approach to achieving increased effective jet array density through the use of a drop emitter 520 having multiple rows of jets 122 that are interdigitated. For the example of FIG. 26, two rows of jets are provided so that the effective pattern cell density in the array direction, $L_y$, is ½ the jet spacing within a single row, $L_j$.

Figure 27A:
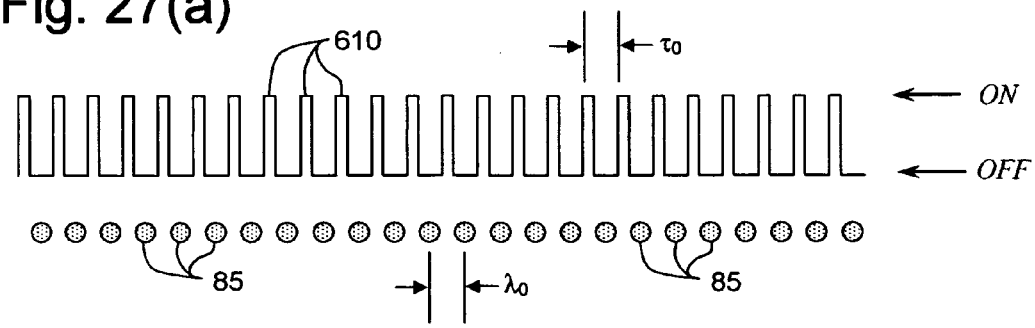
FIG. 27 illustrates a thermal stimulation pulse sequences that result in drops of predetermined unit volume multiples, according to the present inventions.
Figure 27B:
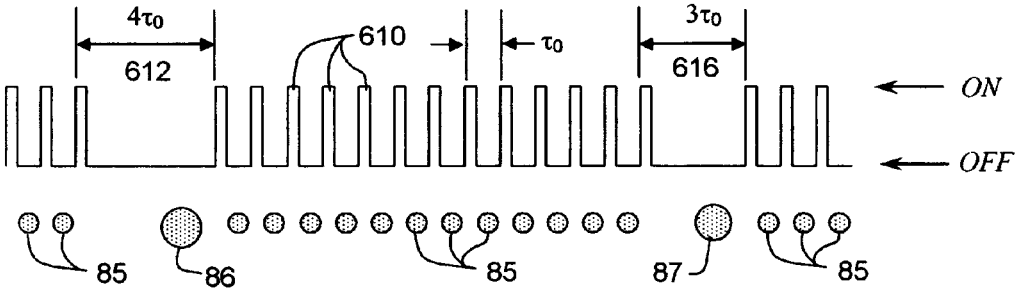
Figure 27C:
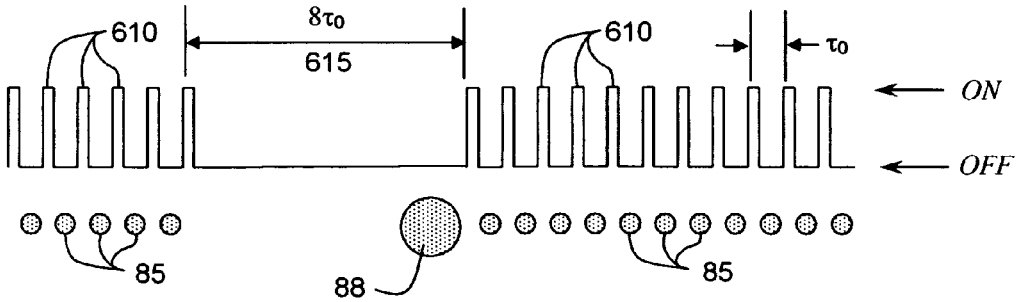

FIG. 27 illustrates an alternate embodiment of the current inventions wherein the thermal stimulation pulses are deleted in a pattern that caused drops having volumes that are multiples of unit volume. Thermal pulse synchronization of the break-up of continuous liquid jets is known to provide the capability of generating streams of drops of predetermined volumes wherein some drops may be formed having integer, m, multiple volumes, $mV_0$, of a unit volume, $V_0$. See for example U.S. Pat. No. 6,588,888 to Jeanmaire, et al. and assigned to the assignee of the present inventions. FIGS. 27(*a*)-27(*c*) illustrate thermal stimulation of a continuous stream by several different sequences of electrical energy pulses. The energy pulse sequences are represented schematically as turning a heater resistor "on" and "off" at during unit periods, $\tau_0$.

In FIG. 27(*a*) the stimulation pulse sequence consists of a train of unit period pulses 610. A continuous jet stream stimulated by this pulse train is caused to break-up into drops 85 all of volume $V_0$, spaced in time by $\tau_0$ and spaced along their flight path by $\lambda_0$. The energy pulse train illustrated in FIG. 27(*b*) consists of unit period pulses 610 plus the deletion of some pulses creating a $4\tau_0$ time period for sub-sequence 612 and a $3\tau_0$ time period for sub-sequence 616. The deletion of stimulation pulses causes the fluid in the jet to collect into drops of volumes consistent with these longer that unit time periods. That is, subsequence 612 results in the break-off of a drop 86 having volume $4V_0$ and subsequence 616 results in a drop 87 of volume $3V_0$. FIG. 27(*c*) illustrates a pulse train having a sub-sequence of period $8\tau_0$ generating a drop 88 of volume $8V_0$. The use of alternative stimulation pulse patterns, consistent with operation of a very high speed, high quality CIJ apparatus for the deposition of materials, has not been previously recognized because the system operation has not been previously considered in view of the design rules for nozzle architecture.

The inventions have been described in detail with particular reference to certain preferred embodiments thereof, but it will be understood that variations and modifications can be effected within the spirit and scope of the inventions.

PARTS LIST

10 substrate for heater resistor elements
11 pressurized liquid supply chamber and flow separator member
12 insulator layer
14 passivation layer
16 interconnection conductor layer
18 resistive heater
20 contact to underlying MOS circuitry
22 common current return electrical conductor
24 underlying MOS circuitry for heater apparatus
28 flow separator
30 nozzle
32 nozzle plate
40 pressurized liquid supply manifold
42 drop emission system support
44 pressurized liquid inlet in phantom view
46 strength members formed in substrate 10
48 pressurized liquid supply chamber
50 substrate for drop charging apparatus
53 insulating layer
54 insulating layer
55 lead attached to charging electrode 210
60 positively pressurized liquid
62 continuous stream of liquid
64 natural surface waves on the continuous stream of liquid
66 drops resulting from natural stream break-up
70 stimulated surface waves on the continuous stream of liquid
76 operating break-off length
77 natural break-off length
80 drops of predetermined volume
82 uncharged drops
84 inductively charged drop(s)
85 drop(s) having the predetermined unit volume $V_o$
86 drop(s) having volume $mV_o$, m=4
87 drop(s) having volume $mV_o$, m=3
88 drop(s) having volume $mV_o$, m=8
89 inductively charged drop(s) having volume $mV_o$, m=4
100 fluid stream without synchronizing stimulation
110 stream of drops of predetermined volume
120 stream of charged and uncharged drops
150 pattern cell at 300 cpi
151 pattern cell at 600 cpi
152 addressable locations within a pattern cell
153 pattern cell at 1200 cpi
154 representation of drops at time of impact on receiver
210 charging electrode for inductively charging stream 62
250 Coulomb force deflection apparatus
252 porous conductor ground plane deflection apparatus
270 gutter to collect drops not used for deposition on the receiver
274 guttered liquid return manifold
276 to vacuum source providing negative pressure to gutter return manifold
400 input data source
410 controller
420 resistive heater apparatus
430 drop emitter head
500 drop emitter having a plurality of jets or drop streams
520 drop emitter having a plurality of interdigitated nozzle arrays
550 drop deposition apparatus
610 representation of stimulation thermal pulses for drops 85
612 representation of deleted stimulation thermal pulses for drop 86
615 representation of deleted stimulation thermal pulses for drop 88
616 representation of deleted stimulation thermal pulses for drop 87

The invention claimed is:

1. A drop deposition apparatus for laying down a patterned liquid layer on a receiver substrate comprising:

a drop emitter containing a positively pressurized liquid in flow communication with a linear array of nozzles for emitting a plurality of continuous streams of liquid having nominal stream velocity $v_{j0}$, and wherein the plurality of nozzles have effective nozzle diameters $D_0$ and extend in an array direction with an effective nozzle spacing $L_y$;

resistive heater apparatus adapted to transfer thermal energy pulses of period $\tau_0$ to the liquid in flow communication with the plurality of nozzles sufficient to cause the break-off of the plurality of continuous streams of liquid into a plurality of streams of drops of predetermined nominal drop volume $V_0$; and relative motion apparatus adapted to move the drop emitter and receiver substrate relative to each other in a process direction at a process velocity S so that individual drops are addressable to the receiver substrate with a process direction addressability, $A_p=\tau_0 S$; and wherein the effective nozzle spacing $L_y$ is less than 85 microns, the process speed S is at least 1 meter/sec and the addressability, $A_p$, of individual drops at the receiver substrate in the process direction is less than 6 microns.

2. The drop deposition apparatus of claim 1 wherein the liquid is an ink, the drop emitter is a continuous ink jet printhead, and the patterned liquid layer is an image.

3. The drop deposition apparatus of claim 1 wherein the relative motion apparatus moves the drop emitter in the process direction at the process speed during the laying down of the patterned liquid layer.

4. The drop deposition apparatus of claim 1 wherein the nominal stream velocity is at least 10 meters/second and less than 20 meter/second, 12 m/sec$<v_{j0}<$20 m/sec.

5. The drop deposition apparatus of claim 1 wherein the effective nozzle diameter is greater than 6 microns and less than 13 microns, 6 μm$<D_0<$13 μm.

6. The drop deposition apparatus of claim 5 wherein the predetermined nominal drop volume $V_0$ is substantially equal to the volume in a disturbance wavelength, $\lambda_0=\tau_0 v_{jo}$, of the stream of liquid and a wave ratio ratio, $L_0$, of the disturbance wavelength to the nozzle diameter is greater than 4 and less than 7, $L_0=\lambda_0 D_0$, $4<L<7$.

7. The drop deposition apparatus of claim 1 wherein the patterned liquid layer laid down on the receiver substrate has a predetermined maximum wet thickness, $h_w$, greater than 5 microns and less than 20 microns, 5 μm$<h_w<$20 μm.

8. The drop deposition apparatus of claim 1 wherein a unit pattern length in the process direction, $L_x$, is predetermined to have a length that is less than or equal to the effective nozzle spacing and greater than or equal to a grey level integer multiple, N, of the process direction addressability, $NA_p \leqq L_x \leqq L_y$;

the patterned liquid layer is formed as a matrix of rectangular pattern cells having dimensions $L_x$ by $L_y$;

the process direction addressability is less than 6 microns; and the grey level integer N is greater than or equal to 15.

9. The drop deposition apparatus of claim 8 wherein the patterned liquid layer laid down on the receiver substrate has a predetermined maximum wet thickness, $h_w$, and a corresponding maximum pattern cell liquid volume, $V_m$, laid down in any rectangular pattern cell, $V_m=h_wL_xL_y$; and wherein the nominal drop volume is substantially equal to the maximum pattern cell liquid volume divided by the grey level integer, $V_0 \approx V_m/N$.

10. The drop deposition apparatus of claim 8 wherein an integer number M+N drops are formed in each stream of drops during a unit pattern length time $t_x=L_x/S$, $(M+N)\tau_0=L_x/S$, where $M \geqq 1$ and a maximum of N drops are deposited on the receiver substrate from any stream of drops during the unit pattern length time.

11. The drop deposition apparatus of claim 1 wherein the effective nozzle spacing $L_y$ is less than 43 microns;

a unit pattern length in the process direction, $L_x$, is predetermined to have a length that is less than or equal to the effective nozzle spacing and greater than or equal to a grey level integer multiple, N, of the process direction addressability, $NA_p \leqq L_x \leqq L_y$;

the patterned liquid layer is formed as a matrix of rectangular pattern cells having dimensions $L_x$ by $L_y$;

the process direction addressability is less than 6 microns; and the grey level integer N is greater than or equal to 4.

12. The drop deposition apparatus of claim 11 wherein the linear array of nozzles is comprised of two rows of nozzles spaced by twice the effective nozzle spacing Ly and the nozzles of the two rows are interdigitated with respect to each other.

13. The drop deposition apparatus of claim 12 wherein the linear array of nozzles is comprised of two rows of nozzles spaced by twice the effective nozzle spacing $L_y$ and the nozzles of the two rows are interdigitated with respect to each other.

14. The drop deposition apparatus of claim 1 wherein the effective nozzle spacing $L_y$ is less than 22 microns;

a unit pattern length in the process direction, $L_x$, is predetermined to have a length that is less than or equal to the effective nozzle spacing and greater than or equal to a grey level integer multiple, N, of the process direction addressability, $NA_p \leqq L_x \leqq L_y$;

the patterned liquid layer is formed as a matrix of rectangular pattern cells having dimensions $L_x$ by $L_y$;

the process direction addressability is less than 6 microns; and the grey level integer N is greater than or equal to 2.

15. The drop deposition apparatus of claim 1 wherein the predetermined volumes of drops include drops of a unit volume, $V_0$, and drops having volumes that are integer multiples of the unit volume, $mV_0$, wherein m is an integer greater than 1.

16. The drop deposition apparatus of claim 1 further comprising charging apparatus adapted to inductively charge at least one drop of the plurality of streams of drops of predetermined nominal drop volume $V_0$, the at least one inductively charged drop having an initial flight trajectory; and electric field deflection apparatus adapted to generate a Coulomb force on the inductively charged drop in a direction transverse to the initial flight trajectory, thereby causing the inductively charged drop to follow a deflected flight trajectory.

17. A drop deposition apparatus for laying down a patterned liquid layer on a receiver substrate comprising:

a drop emitter containing a positively pressurized liquid in flow communication with a linear array of nozzles for emitting a plurality of continuous streams of liquid having nominal stream velocity $v_{j0}$, and wherein the plurality of nozzles have effective nozzle diameters $D_0$ and extend in an array direction with an effective nozzle spacing $L_y$;

resistive heater apparatus adapted to transfer thermal energy pulses of period $\tau_0$ to the liquid in flow communication with the plurality of nozzles sufficient to cause the break-off of the plurality of continuous streams of liquid into a plurality of streams of drops of predetermined nominal drop volume $V_0$; and relative motion apparatus adapted to move the drop emitter and receiver substrate relative to each other in a process direction at a process velocity S so that individual drops are addressable to the receiver substrate with a process direction addressability, $A_p=\tau_0 S$; and wherein the effective nozzle spacing $L_y$ is less than 43 microns, the process speed S is at least 2 meter/sec and the addressability, $A_p$, of individual drops at the receiver substrate in the process direction is less than 6 microns.

18. The drop deposition apparatus of claim 17 wherein the nominal stream velocity is at least 12 meter/second and less than 20 meter/second, 12 m/sec$<v_{j0}<$20 m/sec.

19. The drop deposition apparatus of claim 17 wherein the effective nozzle diameter is greater than 6 microns and less than 10 microns, 6 μm$<D_0<$10 μm.

20. The drop deposition apparatus of claim 17 wherein a unit pattern length in the process direction, $L_x$, is predetermined to have a length that is less than or equal to the effective nozzle spacing and greater than or equal to a grey level integer multiple, N, of the process direction addressability, $NA_p \leqq L_x \leqq L_y$;

the patterned liquid layer is formed as a matrix of rectangular pattern cells having dimensions $L_x$ by $L_y$;

the grey level integer N is greater than or equal to 4.

21. The drop deposition apparatus of claim 17 wherein the effective nozzle spacing $L_y$ is less than 23 microns;

a unit pattern length in the process direction, $L_x$, is predetermined to have a length that is less than or equal to the effective nozzle spacing and greater than or equal to a grey level integer multiple, N, of the process direction addressability, $NA_p \leqq L_x \leqq L_y$;

the patterned liquid layer is formed as a matrix of rectangular pattern cells having dimensions $L_x$ by $L_y$;

the process direction addressability is less than 5 microns; and the grey level integer N is greater than or equal to 2.

22. The drop deposition apparatus of claim 21 wherein the effective nozzle diameter is greater than 6 microns and less than 8 microns, 6 μm$<D_0<$8 μm.

23. The drop deposition apparatus of claim 21 wherein the process speed S is at least 3 meter/sec.

24. The drop deposition apparatus of claim 23 wherein the patterned liquid layer laid down on the receiver substrate has a predetermined maximum wet thickness, $h_w$, greater than 5 microns and less than 15 microns, 5 μm$<h_w<$15 μm.

25. The drop deposition apparatus of claim 17 wherein the predetermined volumes of drops include drops of a unit volume, $V_0$, and drops having volumes that are integer multiples of the unit volume, $mV_0$, wherein m is an integer greater than 1.

26. The drop deposition apparatus of claim 17 further comprising charging apparatus adapted to inductively charge at least one drop of the plurality of streams of drops of predetermined nominal drop volume $V_O$, the at least one inductively charged drop having an initial flight trajectory; and electric field deflection apparatus adapted to generate a Coulomb force on the inductively charged drop in a direction transverse to the initial flight trajectory, thereby causing the inductively charged drop to follow a deflected flight trajectory.

* * * * *

UNITED STATES PATENT AND TRADEMARK OFFICE

CERTIFICATE OF CORRECTION

PATENT NO. : 7,249,829 B2
APPLICATION NO. : 11/130621
DATED : July 31, 2007
INVENTOR(S) : Gilbert A. Hawkins et al.

It is certified that error appears in the above-identified patent and that said Letters Patent is hereby corrected as shown below:

| | |
|---|---|
| Column 26, Line 50 | In Claim 6, delete "ratio," before "$L_0$,". |
| Column 27, Line 30 | In Claim 12, delete "Ly" and insert -- $L_y$ --. |

Signed and Sealed this

Sixth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,249,829 B2
APPLICATION NO. : 11/130621
DATED : July 31, 2007
INVENTOR(S) : Gilbert Allen Hawkins et al.

It is certified that error appears in the above-identified patent and that said Letters Patent is hereby corrected as shown below:

| Issued Patent | | Description of Error |
|---|---|---|
| **Column** | **Line** | |
| 26 | 52 | In Claim 6, delete " $L_0 = \lambda_0 D_0, 4 < L < 7$ " and Insert -- $L_0 = \lambda_d D_0, 4 < L < 7$ -- |

Signed and Sealed this
Twenty-third Day of August, 2011

David J. Kappos

David J. Kappos
*Director of the United States Patent and Trademark Office*